US006423484B1

(12) United States Patent
Yoshioka et al.

(10) Patent No.: US 6,423,484 B1
(45) Date of Patent: Jul. 23, 2002

(54) SILVER HALIDE COLOR PHOTOGRAPHIC LIGHT-SENSITIVE MATERIAL

(75) Inventors: Yasuhiro Yoshioka; Takehiko Sato; Osamu Takahashi; Toshio Kawagishi; Kozo Sato; Yuki Mizukawa, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/736,391

(22) Filed: Dec. 15, 2000

Related U.S. Application Data

(63) Continuation of application No. 08/287,920, filed on Aug. 9, 1994, now abandoned.

(30) Foreign Application Priority Data

Aug. 10, 1993 (JP) ..... 5-216874
Nov. 15, 1993 (JP) ..... 5-307110

(51) Int. Cl.[7] ..... G03C 7/305; G03C 7/388; G03C 7/32

(52) U.S. Cl. ..... 430/546; 430/558

(58) Field of Search ..... 430/558, 546

(56) References Cited

U.S. PATENT DOCUMENTS 5,302,502 A * 4/1994 Shibata ..... 430/546
5,370,983 A * 12/1994 Shono et al. ..... 430/546

FOREIGN PATENT DOCUMENTS

| | | |
|---|---|---|
| EP | 382443 A2 | 8/1990 |
| JP | A-2-230240 | 9/1990 |
| JP | A-3-2748 | 1/1991 |

* cited by examiner

*Primary Examiner*—Janet Baxter
*Assistant Examiner*—Amanda C Walke
(74) *Attorney, Agent, or Firm*—Sughrue Mion, PLLC

(57) ABSTRACT

There is disclosed a silver halide color photographic light-sensitive material which excels in a color reproduction and an image fastness and which has an excellent color developability. The above silver halide color photographic light-sensitive material comprises a support and provided thereon a yellow color-developing light-sensitive silver halide emulsion layer, a magenta color-developing light-sensitive silver halide emulsion layer and a cyan color-developing light-sensitive silver halide emulsion layer each having a different color-sensitivity, wherein the above magenta color-developing light-sensitive silver halide emulsion layer contains at least one of the non-diffusible dye-forming couplers represented by the following Formula (M), a high boiling organic solvent having a dielectric constant of 6.0 or less and a refraction index of 1.50 or less, and at least one of the water insoluble polymers which are obtained by polymerizing at least one of the monomers having an aromatic group:

Formula (M)

wherein $R_1$ represents a hydrogen atom or a substituent; Z represents a non-metal atomic group which is necessary to form a 5-membered azole ring containing 2 to 4 nitrogen atoms and the above azole ring may contain a substituent (including a condensed ring); and X represents a hydrogen atom or a group capable of splitting off upon a coupling reaction with an oxidation product of a developing agent.

22 Claims, No Drawings

SILVER HALIDE COLOR PHOTOGRAPHIC LIGHT-SENSITIVE MATERIAL

This is a continuation of application Ser. No. 08/287,920 filed Aug. 9, 1994, the disclosure of which is incorporated herein by reference abandoned.

FIELD OF THE INVENTION

The present invention relates to a silver halide color photographic light-sensitive material, more specifically to a silver halide color photographic light-sensitive material which excels in a color reproduction and an image fastness and which has an excellent color developability.

BACKGROUND OF THE INVENTION

In general, in a color image forming-process using a silver halide color photographic light-sensitive material, a color image is formed from three color dyes derived from yellow, magenta and cyan couplers.

An aptitude of a color developability in each color is judged by an absorption characteristic, and the absorption characteristic of a color-developed dye can be shown by a spectral absorbing wave form, that is, a characteristic value such as a maximum absorbing wavelength and an absorption coefficient. In addition to these values, a presence of a sub-absorption, a width of an absorption band and a sharpness of an absorption end are important in a problem on a color reproduction of a color photo. For example, a white light is composed of a blue light (400 to 500 nm), a green light (500 to 600 nm) and a red light (600 to 800 nm). Absorption of the green light by a magenta dye provides a red purple color which is the complementary color thereof. In this case, an inferior absorption characteristic of the magenta dye allows a part of the blue light and the red light to be absorbed and causes a hue to be turbid. A vivid color can not be reproduced with the dye having such the inferior absorption characteristic.

A magenta coupler determines a quality of a color development of a green color which is the most sensitive to a human being's eye and therefore, the absorption characteristic thereof is important. In recent years, a pyrazoloazole series coupler having an excellent absorption characteristic has been developed as the magenta coupler in order to improve a color reproduction. Of them, a 1H-pyrazolo[3,2-c][1,2,4]triazole series magenta coupler and a 1H-pyrazolo[1,5-b][1,2,4]triazole series magenta coupler are excellent in terms of not only an absorption characteristic of a dye but also a color developability as compared with the other couplers. The pyrazolotriazole type coupler does not show a sub-absorption in a blue light region as compared with a pyrazolone type coupler and the absorption end thereof at a longer wavelength side is sharply cut, and an excessive absorption in a red light region is very small as well.

An optimum absorption wavelength of a magenta dye is varied according to a cyan coupler and a yellow coupler which are used in combination therewith, and therefore in a dye derived from the magenta coupler having such the absorption characteristic as described above, absence of an absorbing wavelength in a suitable position causes an another problem. That is, an absorption in a too short wavelength region generates a region in which a light is not sufficiently absorbed at an interval to an absorption region of a cyan dye and leads to incapability to reproduce a vivid purple color and black color. On the contrary, an absorption in a too long wavelength region generates a region in which a light is not sufficiently absorbed an interval to an absorption region of a yellow dye and leads to incapability to reproduce a vivid red color and black color. Accordingly, a technique for controlling a hue is important in the pyrazoloazole series coupler more than in the pyrazolone type coupler.

Further, an optimum absorption wavelength of the magenta dye is varied as well according to a use purpose of a light-sensitive material. In the case where the light-sensitive material is used, for example, as a block copy, a design is required to be made so that the optimum absorption wavelength is shifted to a shorter wavelength than in case of a conventional color print to meet a hue of a printing ink. That requires a technique for freely controlling the hue.

With respect to the technique for controlling the hue, the hue can be controlled with a substituent. For example, in the couplers having the same primary structure, an absorption wavelength of a dye formed can be changed according to the kind of the substituent. A degree of controlling the hue is varied according to a position into which the substituent is introduced. In general, introduction of an electron attractive group causes a long wavelength shift and the introduction of an electron donative group causes a short wavelength shift.

However, such a change in the substituent is accompanied with a change in a performance which is important for a coupler, such as, for example, a coupling activity and a fastness to heat and light. These performances are not necessarily changed to a preferable direction at the same time as controlling the hue. As a matter of fact, this requires to select and use a coupler which has a lot of the averagely excellent performances and provides a working load for selecting the coupler.

Even if the same coupler would be used, the absorption wavelength of the dye can be controlled to some extent according to the use method thereof, for example, a kind and an amount of a high boiling organic solvent used for emulsion-dispersion and use of the other additives. The most important is a polarity of the high boiling organic solvent represented by a dielectric constant, a hydrogen bonding property and an electron donating property. Of them, the dielectric constant is used as a parameter for the polarity in many cases. The high boiling organic solvent having the high dielectric constant allows an absorption wavelength to be shifted to a shorter wavelength. A molecular structure of the high boiling organic solvent for raising the dielectric constant is a polar group containing a hetero atom and a structure containing a lot of an aromatic ring, and the high boiling organic solvent which is used well includes, for example, tricresyl phosphate and dibutyl phthalte. Meanwhile, the molecular structure of the high boiling organic solvent for lowering the dielectric constant is a structure containing a lot of a part of a hydrophobic aliphatic chain and includes, for example, trioctyl phosphate and fatty acid alkyl esters. A hue control by such the high boiling organic solvent affects a color developability of a coupler and a fastness of a dye in some cases but succeeds to some extent.

It is known that an addition of a compound having a phenolic hydroxyl group and a sulfonamide group can allow an absorption by a dye to be shifted to a longer wavelength.

However, an additive which allows an absorption wavelength to be shifted to a shorter wavelength is not known.

A relationship of a dielectric constant of the high boiling organic solvent with a hue is described in N. S. Bayliss and E. G. McRae, J. Phys. Chem. 58, 1002, 1006 (1954).

Meanwhile, there are described in European Patents EP0276319 and EP0382443, the processes in which the polymers derived from acrylic acid ester, acrylamide and styrene are added to an oil drop together with a coupler for a purpose of improving a fastness of a dye to light and heat. In this case, the polymers generally have a molecular weight of not much more than 10,000 to 200,000. In the case where the polymer has the molecular weight of 20,000 or more, it is excellent in terms of an anti-discoloring effect but includes a problem that it lowers a color developability of the coupler.

The present inventors investigated to use the high boiling organic solvent with which a success has been gained to some extent for a purpose of controlling a hue of the magenta coupler of the present invention based on a conventional knowledge. That resulted in obtaining an almost satisfactory result regarding a shift to a longer wavelength but it was clarified that a serious problem was still remained regarding a shift to a shorter wavelength. That is, in the case where the high boiling organic solvent having a low dielectric constant is used in order to shift a hue of a coupler to a shorter wavelength, a turbidity is generated in a coated film. This turbidty of the coated film originates in a low refraction index of the high boiling organic solvent with a low dielectric constant containing an aliphatic chain. The presence of a large difference between the refraction index of an oil drop containing a coupler and that of gelatin allows light to be diffused on a oil drop surface to generate a turbidity in a coated film. Since gelatin has a relatively high refraction index, a so large problem is not caused in the high boiling organic solvent having a high dielectric constant. However, in case of the high boiling organic solvent having a low refraction index with a low dielectric constant, a problem is caused. There is a correlation between the dielectric constant and the refraction index of the high boiling organic solvent to some extent, and the high boiling organic solvent having the low dielectric constant has the low refraction index as well in many cases.

Thus, the use of the high boiling organic solvent having the low dielectric constant and refraction index can shift an absorption wavelength to a shorter wavelength.

However, since in a multi-layer color light-sensitive material for an actual use, a turbidity is generated as well in a magenta color-developing layer, this visually reduces a color developing density in a yellow color-developing light-sensitive layer to a large extent. This reduction of the color developing density in the yellow color-developing light-sensitive layer can be corrected by increasing a coated amount but it is not preferred because of an increase in a cost.

SUMMARY OF THE INVENTION

The present invention was made under the circumstances described above. Accordingly, the first object of the present invention is to provide a silver halide color photographic light-sensitive material in which an absorption wavelength of a magenta dye derived from a pyrazoloazole type magenta coupler is controlled according to a purpose and a turbidity in a coated film is a little.

The second object of the present invention is to provide a silver halide color photographic light-sensitive material which provides an excellent color reproduction by using the above process.

The third object of the present invention is to provide a silver halide color photographic light-sensitive material which provides an excellent dye image fastness.

The fourth object of the present invention is to provide a silver halide color photographic light-sensitive material which provides a high economical efficiency by reducing a use amount of a yellow coupler.

The above objects of the present invention have been achieved by the following silver halide color photographic light-sensitive material. That is, (1) A silver halide color photographic light-sensitive material comprising a support and provided thereon a yellow color-developing light-sensitive silver halide emulsion layer, a magenta color-developing light-sensitive silver halide emulsion layer and a cyan color-developing light-sensitive silver halide emulsion layer each having a different color-sensitivity, wherein the above magenta color-developing light-sensitive silver halide emulsion layer contains at least one of the non-diffusible dye-forming couplers represented by the following Formula (M), a high boiling organic solvent having a dielectric constant of 6.0 or less and a refraction index of 1.50 or less, and at least one of the water insoluble polymers which are obtained by polymerizing at least one of the monomers having an aromatic group:

Formula (M)

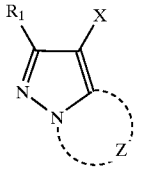

wherein $R_1$ represents a hydrogen atom or a substituent; Z represents a non-metal atomic group which is necessary to form a 5-membered azole ring containing 2 to 4 nitrogen atoms and the above azole ring may contain a substituent (including a condensed ring); and X represents a hydrogen atom or a group capable of splitting off upon a coupling reaction with an oxidation product of a developing agent.

(2) The silver halide color photographic light-sensitive material described in above (1), wherein the dye-forming coupler represented by Formula (M) is represented by the following Formula (M-I), (M-II), (M-III), (M-IV) or (M-V):

[M-I]

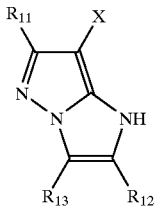

[M-II]

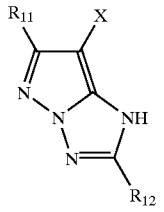

[M-III]

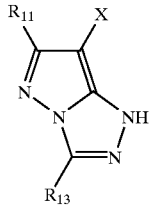

-continued

[M-IV]

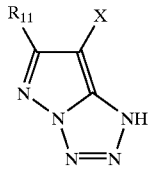

[M-V]

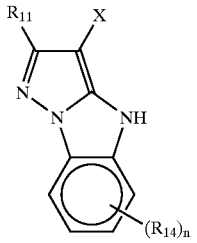

wherein $R_{11}$, $R_{12}$, $R_{13}$ and $R_{14}$ each represent a hydrogen atom or a substituent.

(3) The silver halide color photographic light-sensitive material described in above (1), wherein the dye-forming coupler represented by Formula (M) is represented by the following Formula (M-IIA) or (M-IIIA):

[M-IIA]

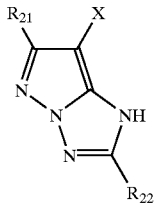

[M-IIIA]

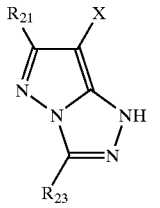

wherein $R_{21}$ represents a secondary or tertiary alkyl group or a secondary or tertiary cycloalkyl group; and $R_{22}$ and $R_{23}$ each represent a hydrogen atom or a substituent.

(4) The silver halide color photographic light-sensitive material described in above (1), wherein the water insoluble polymer has a number-average molecular weight of 200,000 or less.

(5) The silver halide color photographic light-sensitive material described in above (4), wherein the water insoluble polymer has a number-average molecular weight of 10,000 or less.

(6) The silver halide color photographic light-sensitive material described in above (5), wherein the water insoluble polymer is a polymer with a number-average molecular weight of 10,000 or less having a monomer unit derived from at least one of styrene, α-methylstyrene and β-methylstyrene.

(7) The silver halide color photographic light-sensitive material described in above (3), wherein $R_{21}$ in Formulas (M-IIA) and (M-IIIA) is a secondary or tertiary cycloalkyl group or a secondary or tertiary bicycloalkyl group.

(8) The silver halide color photographic light-sensitive material described in above (3), wherein $R_{21}$ in Formulas (M-IIA) and (M-IIIA) is an adamantyl group, 2,2,2-bicyclooctane-1-yl group, 1-alkylcyclopropane-1-yl group, 1-alkylcyclohexane-1-yl group, or 2,6-dialkylcyclohexane-1-yl group.

(9) The silver halide color photographic light-sensitive material described in above (1), wherein the coupler of Formula (M) described above has at least one group represented by —P═O as a partial structure in the molecule thereof (provided that a part of X is excluded).

DETAILED DESCRIPTION OF THE INVENTION

In the present invention, a light-sensitive material which excels in a color reproduction and a dye image fastness can be obtained without increasing a use amount of a yellow coupler by incorporating a specific pyrazoloazole series magenta coupler, a high boiling organic solvent having a dielectric constant of 6.0 or less and a refraction index of 1.50 or less and a water insoluble polymer having an aromatic group into a magenta color-developing light-sensitive layer even with an absorption wavelength of magenta dye controlled to a shorter wavelength.

That is, a turbidity in a magenta color-developing layer which is generated in using an organic solvent having a low dielectric constant can be controlled and a good image can be obtained by shifting a hue of a magenta to a shorter wavelength and incorporating a water insoluble polymer having an aromatic group.

A mechanism by which a turbidity in a coated film of the magenta color-developing layer which is generated in using a high boiling organic solvent having a low dielectric constant is suppressed by adding the water insoluble polymer having an aromatic group is not known well. It was concerned at a stage of investigating the present invention that an effect of shifting a hue to a shorter wavelength by the high boiling organic solvent having a low dielectric constant might be canceled by adding this polymer. However, to be quite surprised, the test results were entirely contrary to an anticipation and a turbidity in a coated film could be suppressed while maintaining an effect of shifting to a shorter wavelength.

Further, the use of the water insoluble polymer according to the present invention (hereinafter referred to simply as the polymer) in combination with the magenta coupler of the present invention in which $R_{21}$ in Formulas (M-IIA) and (M-IIIA) is a cycloalkyl group or a bicycloalkyl group or which has a —P═O group as a partial structure in the molecule of the coupler of Formula (M) described above is preferred since a reduction in a yellow color-developing density is improved, a magenta color-developing density is improved and a light fastness becomes better.

The coupler represented by Formula (M) will be explained in detail.

Of the couplers represented by Formula (M), the preferred ones are presented by Formulas (M-I), (M-II), (M-III), (M-IV) and (M-V):

[M-I]

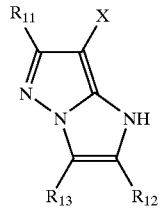

[M-II]

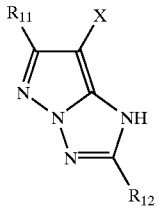

[M-III]

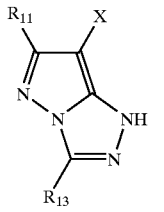

[M-IV]

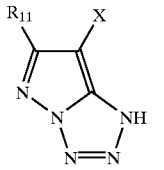

[M-V]

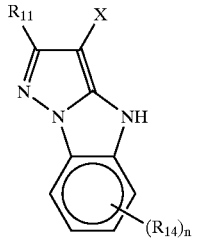

In Formulas (M) and (M-I) to (M-V), $R_1$, $R_{11}$, $R_{12}$, $R_{13}$ and $R_{14}$ each represent a hydrogen atom or a substituent, the substituent including a halogen atom, an alkyl group, a cycloalkyl group, an alkenyl group, an aryl group, a heterocyclic group, a cyano group, a hydroxyl group, a nitro group, a carboxyl group, an alkoxy group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamide group, an alkoxycarbonylamino group, an aryloxycarbonylamino group, a ureido group, a sulfonamido group, a sulfamoylamino group, an imido group, an azo group, a mercapto group, an alkylthio group, an arylthio group, a heterocyclic thio group, a sulfinyl group, a sulfo group, an alkanesulfonyl group, an arenesulfonyl group, a sulfamoyl group, a sulfo group, or a phosphonyl group. They each may form a bis product via a divalent group. Further, they may be combined with a main chain of the polymer to form a polymer coupler. n represents an integer of 1 to 4, preferably an integer of 1 to 3. When n represents an integer of 2 or more, two or more $R_{14}$ groups may be the same or different.

The alkyl group (a residue), the cycloalkyl group, the aryl group (a residue) and the heterocyclic group (a residue) each described above may further be substituted with a substituent (a ballast group). At least one of the substituents for a pyrazoloazole ring group nucleus preferably contains a ballast group.

To be more detailed, $R_1$, $R_{11}$, $R_{12}$, $R_{13}$ and $R_{14}$ each represent a halogen atom (for example, a fluorine atom, a chlorine atom and a bromine atom), an alkyl group (preferably a linear or branched alkyl group having 1 to 32 carbon atoms, for example, methyl, ethyl, propyl, isopropyl, butyl, t-butyl, 1-octyl, and tridecyl), a cycloalkyl group (preferably a secondary or tertiary cycloalkyl group or bicycloalkyl group, for example, cyclopropyl, cyclopentyl, cyclohexyl, bicyclocyl, and adamantyl), an alkenyl group (preferably an alkenyl group having 2 to 32 carbon atoms, for example, vinyl, allyl and 3-butene-1-yl), an aryl group (preferably an aryl group having 6 to 32 carbon atoms, for example, phenyl, 1-naphthyl and 2-naphthyl), a heterocyclic group (preferably a 5- to 8-membered heterocyclic group having 1 to 32 carbon atoms, for example, 2-thienyl, 4-pyridyl, 2-furyl, 2-pyrimidinyl, 1-pyridyl, 2-benzothiazolyl, 1-imidazolyl, 1-pyrazolyl, and benzotriazole-2-yl), a cyano group, a halogen atom (for example, a fluorine atom, a chlorine atom and a bromine atom), a hydroxyl group, a nitro group, a carboxyl group, an alkoxy group (preferably an alkoxy group having 1 to 32 carbon atoms, for example, methoxy, ethoxy, 1-butoxy, 2-butoxy, isopropoxy, t-butoxy, dodecyloxy), a cycloalkyloxy group (preferably a cycloalkyloxy group having 3 to 8 carbon atoms, for example, cyclopentyloxy and cyclohexyloxy), an aryloxy group (preferably an aryloxy group having 6 to 32 carbon atoms, for example, phenoxy and 2-naphthoxy), a heterocyclic oxy group (preferably a heterocyclic oxy group having 1 to 32 carbon atoms, for example, 1-phenyltertazole-5-oxy, 2-tetrahydropyranyloxy and 2-furyloxy), a silyloxy group (preferably a silyloxy group having 1 to 32 carbon atoms, for example, trimethylsilyloxy, t-butyldimethylsilyloxy and diphenylmethylsilyloxy), an acyloxy group (preferably an acyloxy group having 2 to 32 carbon atoms, for example, acetoxy, pivaloyloxy, benzoyloxy, and dodecanoyloxy), an alkoxycarbonyloxy group (preferably an alkoxycarbonyloxy group having 2 to 32 carbon atoms, for example, ethoxycarbonyloxy and t-butoxycarbonyloxy), a cycloalkyloxycarbonyloxy group (preferably a cycloalkyloxycarbonyloxy group having 4 to 9 carbon atoms, for example, cyclohexyloxycarbonyloxy), an aryloxycarbonyloxy group (preferably an aryloxycarbonyloxy group having 7 to 32 carbon atoms, for example, phenoxycarbonyloxy), a carbamoyloxy group (preferably a carbamoyloxy group having 1 to 32 carbon atoms, for example, N,N-dimethylcarbamoyloxy and N-butylcarbamoyloxy), a sulfamoyloxy group (preferably a sulfamoyloxy group having 1 to 32 carbon atoms, for example, N,N-diethylsulfamoyloxy and N-propylsulfamoyloxy), an alkanesulfonyloxy group (preferably an alkanesulfonyloxy group having 1 to 32 carbon atoms, for example, methanesulfonyloxy and hexadecanesulfonyloxy), an arenesulfonyloxy group (preferably an arenesulfonyloxy group having 6 to 32 carbon atoms, for example, benzenesulfonyloxy), an acyl group (preferably an acyl group having 1 to 32 carbon atoms, for example, formyl, acetyl, pivaloyl, benzoyl, and tetradecanoyl), an alkoxycarbonyl group (preferably an alkoxycarbonyl group having 2 to 32 carbon atoms, for example, methoxycarbonyl, ethoxycarbonyl and octadecyloxycarbonyl), a cycloalkyloxycarbonyl group (preferably a cycloalkyloxycarbonyl group having 2 to 32 carbon atoms, for example, cyclohexyloxycarbonyl), an aryloxycarbonyl group (preferably an aryloxycarbonyl group having 7 to 32 carbon atoms, for example, phenoxycarbonyl), a carbamoyl group (preferably a carbamoyl group having 1 to 32 carbon atoms, for example, carbamoyl, N,N-dibutylcarbamoyl, N-ethyl-N-octylcarbamoyl, and N-propylcarbamoyl), an amino group (preferably an amino group having 32 or less carbon atoms, for example, amino, methylamino, N,N-dioctylamino, tetradecylamino, and octadecylamino), an anilino group (preferably an anilino group having 6 to 32 carbon atoms, for example, anilino and N-methylanilino), a heterocyclic amino group (preferably a heterocyclic amino group having 1 to 32 carbon atoms, for example, 4-pyridylamino), a carbonamide group (preferably a carbonamide group having 2 to 32 carbon atoms, for example, acetamide, benzamide and tetradecaneamide), a ureido group (preferably a ureido group having 1 to 32 carbon atoms, for example, ureido, N,N-dimethylureido and N-phenylureido), an imido group (preferably an imido group having 10 or less carbon atoms, for example, N-succinimido and N-phthalimido), an alkoxycarbonylamino group (preferably an alkoxycarbonylamino group having 2 to 32 carbon atoms, for example, methoxycarbonylamino, ethoxycarbonylamino, t-butoxycarbonylamino, and octadecyloxycarbonylamino), an aryloxycarbonylamino group (preferably an aryloxycarbonylamino group having 7 to 32 carbon atoms, for example, phenoxycarbonylamino), a sulfonamide group (preferably a sulfonamide group having 1 to 32 carbon atoms, for example, methanesulfonamide, butanesulfonamide, benzenesulfonamide, and hexadecanesulfonamide), a sulfamoylamino group (preferably a sulfamoylamino group having 1 to 32 carbon atoms, for example, N,N-dipropylsulfamoylamino and N-ethyl-N-dodecylsulfamoylamino), an azo group (preferably an azo group having 1 to 32 carbon atoms, for example, phenylazo), an alkylthio group (preferably an alkylthio group having 1 to 32 carbon atoms, for example, ethylthio and octylthio), an arylthio group (preferably an arylthio group having 6 to 32 carbon atoms, for example, phenylthio), a heterocyclic thio group (preferably an heterocyclic thio group having 1 to 32 carbon atoms, for example, 2-benzothiazolylthio, 2-pyridylthio and 1-phenyltetrazolylthio), an alkylsulfinyl group (preferably an alkylsulfinyl group having 1 to 32 carbon atoms, for example, dodecanesulfinyl), an arenesulfinyl group (preferably an arenesulfinyl group having 6 to 32 carbon atoms, for example, benzenesulfinyl), an alkanesulfonyl group (preferably an alkanesulfonyl group having 1 to 32 carbon atoms, for example, methanesulfonyl and octanesulfonyl), an arenesulfonyl group (preferably an arenesulfonyl group having 6 to 32 carbon atoms, for example, benzenesulfonyl and 1-naphthalenesulfonyl), a sulfamoyl group (preferably an sulfamoyl group having 32 or less carbon atoms, for example, sulfamoyl, N,N-dipropylsulfamoyl and N-ethyl-N-dodecylsulfamoyl), a sulfo group, or a phosphonyl group (preferably a phosphonyl group having 1 to 32 carbon atoms, for example, phenoxyphosphonyl, octyloxyphosphonyl and phenylphosphonyl). These groups may further have a substituent.

The substituents substituted to the groups represented by $R_1$, $R_{11}$, $R_{12}$, $R_{13}$ and $R_{14}$ may be any ones as long as they can be substituted thereto. There can be enumerated as the preferred substituents, a halogen atom, an alkyl group, a cycloalkyl group, an alkenyl group, an aryl group, a heterocyclic group, a cyano group, a hydroxyl group, a nitro group, a carboxyl group, an alkoxy group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, an amino group, an anilino group, a heterocyclic amino group, a carbonamide group, an alkoxycarbonylamino group, an aryloxycarbonylamino group, a ureido group, a sulfonamide group, a sulfamoylamino group, an imido group, an azo group, a mercapto group, an alkylthio group, an arylthio group, a heterocyclic thio group, a sulfinyl group, a sulfo group, an alkanesulfonyl group, an arenesulfonyl group, a sulfamoyl group, and a phosphonyl group.

X represents a hydrogen atom or a group capable of splitting off upon a reaction with an oxidation product of a developing agent. To be detailed, the group capable of splitting off includes a halogen atom, an alkoxy group, an aryloxy group, an acyloxy group, a carbamoyloxy group, a sulfonyloxy group, a carboamide group, a sulfonamide group, a carbamoylamino group, a heterocyclic group, an arylazo group, an alkylthio group, an arylthio group, and a heterocyclic thio group. The preferred ranges and concrete examples of these groups are the same as those enumerated in an explanation for the group represented by $R_1$.

Z represents a non-metal atomic group which is necessary to form a 5-membered azole ring containing 2 to 4 nitrogen atoms, such as diazole ring, triazole ring, tetrazole ring, and the above azole ring may have a substituent represented by $R_1$, $R_{11}$, $R_{12}$, $R_{13}$ and $R_{14}$ and may compose a condensed ring.

A preferred range of the compound represented by Formula (M) will be described below.

Of the pyrazoloazole magenta couplers represented by Formula (M), the couplers represented by Formulas (M-I), (M-II) and (M-III) are preferred, the couplers represented by Formulas (M-II) and (M-III) are more preferred, and the couplers represented by Formula (M-II) are most preferred in terms of the effect of the invention.

In terms of the effect of the invention, preferred is the case in which $R_{11}$ is an alkyl group, a cycloalkyl group, an aryl group, an alkoxy group, an aryloxy group, an alkylthio group, an arylthio group, a ureido group, an oxycarbonylamino group, or an amido group, and further preferred is the case in which $R_{11}$ is an alkyl group, a cycloalkyl group, an aryl group, an alkoxy group, or an aryloxy group. In the case where $R_{11}$ is the alkyl group, $R_{11}$ is preferably methyl, ethyl, isopropyl, or t-butyl, and the case in which $R_{11}$ is a tertiary alkyl group is most preferred. In the case where $R_{11}$ is the cycloalkyl group, $R_{11}$ is preferably a secondary or tertiary cycloalkyl group or a bicycloalkyl group. These groups may further have substituents as described previously.

In terms of the effect of the invention, preferred is the case in which $R_{12}$ is a hydrogen atom, an alkyl group, an aryl group, a heterocyclic group, an alkyloxycarbonyl group, a carbamoyl group, a sulfamoyl group, an acyl group, or a cyano group, further preferred is the case in which $R_{12}$ is an alkyl group or an aryl group, and most preferred is the case in which $R_{12}$ is a secondary or tertiary alkyl group or a phenyl group.

These groups may further have substituents as described above.

In terms of the effect of the invention, preferred is the case in which $R_{13}$ is a hydrogen atom, an alkyl group, an aryl group, a heterocyclic group, an alkylthio group, an arylthio group, an alkoxycarbonyl group, a carbamoyl group, a sulfamoyl group, an acyl group, or a cyano group, and further preferred is the case in which $R_{13}$ is an alkyl group or an aryl group. In the case where $R_{13}$ is the alkyl group, $R_{13}$ is particularly preferably a primary or secondary alkyl group having a group which is substituted with a nitrogen atom, such as a carbonamide group, a sulfonamide group or a ureido group, or a group which is substituted with an oxygen atom, such as an alkoxy group or an aryloxy group, on a carbon atom directly bonded to a pyrazoloazole primary nucleus. Further, the secondary or tertiary alkyl group having no substituent described previously is preferred as well. In the case where $R_{13}$ is the alkyl group, preferred as well is a substituted alkyl group such as an alkyl group having an alkylsulfonyl group, an arylsulfonyl group and a sulfamoyl group. In the case where $R_{13}$ is the aryl group, the case in which $R_{13}$ is phenyl is preferred, and further the case in which $R_{13}$ is phenyl having the substituents described above on a 2-position and a 6-position is most preferred.

In terms of the effect of the invention, preferred is the case in which $R_{14}$ is a hydrogen atom, a halogen atom, an alkyl group, an aryl group, a heterocyclic group, an alkoxy group, an aryloxy group, a carbonamide group, a sulfonamide group, an alkoxycarbonylamino group, a ureido group, an alkylthio group, an arylthio group, an alkoxycarbonyl group, a carbamoyl group, a sulfamoyl group, a sulfonyl group, an acyl group, or a cyano group.

In terms of the effect of the invention, X is preferably a halogen atom, an aryloxy group, a carbamoyloxy group, an acylamino group, a heterocyclic group, an arylazo group, an alkylthio group, an arylthio group, or a heterocyclic thio group, and X is further preferably a halogen atom, an aryloxy group, a heterocyclic group, an alkylthio group, an arylthio group, or a heterocyclic thio group.

Of the couplers represented by Formula (M), the coupler represented by Formula (M-IIA) or Formula (M-IIIA) is particularly preferred.

In Formula (M-IIA) and Formula (M-IIIA) , $R_{21}$, $R_{22}$ and $R_{23}$ represent the same groups as those shown in $R_{11}$, $R_{12}$ and $R_{13}$ in Formula (M-II) and Formula (M-III), respectively. Provided that at least one of $R_{21}$ and $R_{22}$ and at least one of $R_{22}$ and $R_{23}$ are a secondary or tertiary alkyl group or cycloalkyl group, and these groups may further have substituents. Of the couplers represented by Formula (M-IIA) or Formula (M-IIIA), more preferred is a coupler in which $R_{21}$ is a secondary or tertiary alkyl group or cycloalkyl group, and most preferred is a coupler in which $R_{21}$ is a tertiary alkyl group, a secondary or tertiary cycloalkyl group or a secondary or tertiary bicycloalkyl group. A preferred concrete example of these cycloalkyl groups includes adamantyl, 2,2,2-bicyclooctane-1-yl, 1-alkylcyclopropane-1-yl, 1-alkylcyclohexane-1-yl, and 2,6-dialkylcyclohexane-1.

The pyrazoloazole coupler of the present invention can be synthesized by the processes described in U.S. Pat. Nos. 4,500,630 and 4,540,654, JP-B-4-79349 (the term "JP-B" as used herein means an examined Japanese patent publication), JP-B-4-79350, JP-B-4-79351, and European Patent Publications No. 0173256, 0217353 and 0226849.

The concrete examples of the pyrazoloazole magenta coupler which can be used in the present invention will be shown below but the present invention will not be limited thereby.

The abbreviated expressions for the substituents used in the compound examples are shown below.

BAL-1

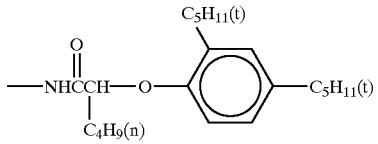

BAL-2

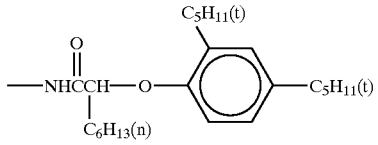

BAL-3

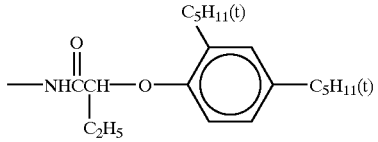

BAL-4

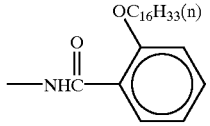

BAL-5

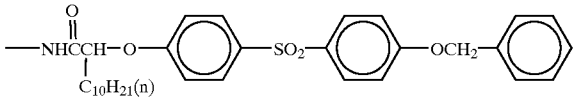

BAL-6

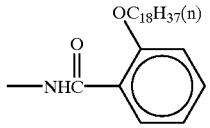

BAL-7

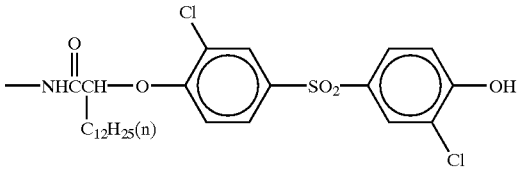

BAL-8

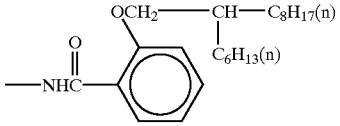

BAL-9

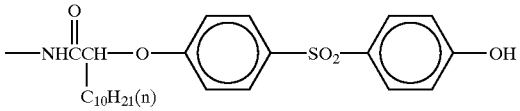

BAL-10

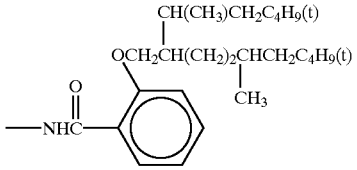

BAL-11

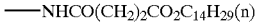

-continued
BAL-12
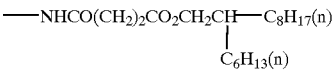
BAL-13
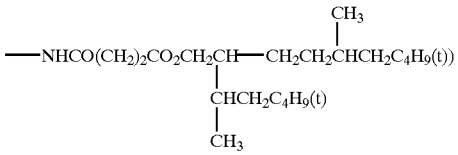
BAL-14
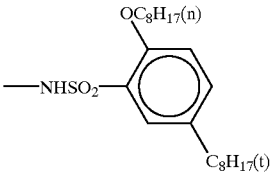
BAL-15
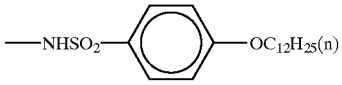
BAL-16
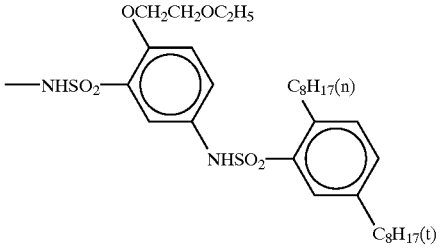
BAL-17
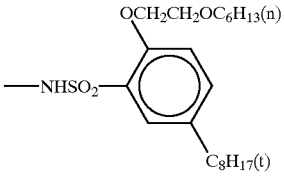
BAL-18
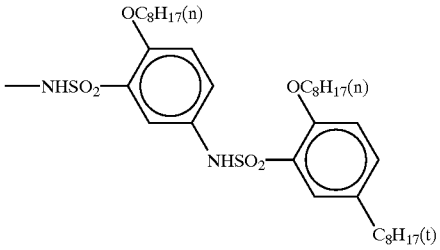
BAL-19
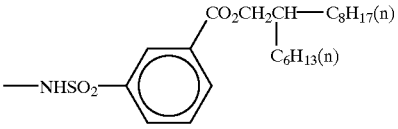
BAL-20
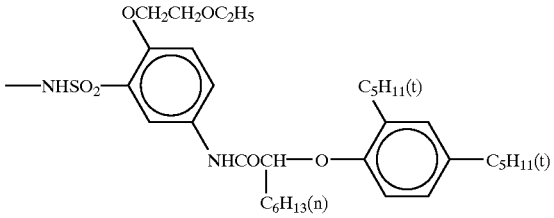
-continued
BAL-21
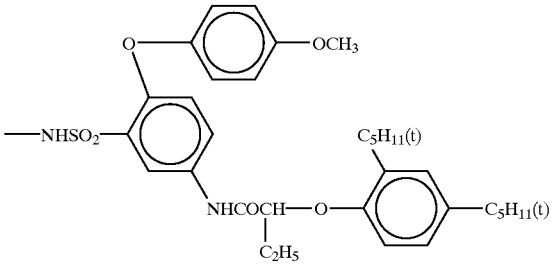
BAL-22
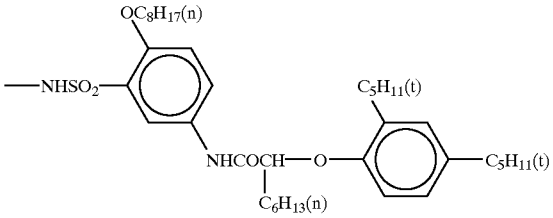
BAL-23
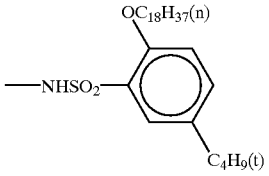
BAL-24
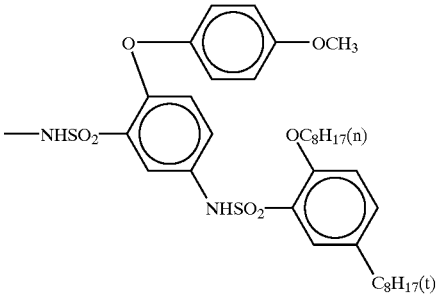
BAL-25
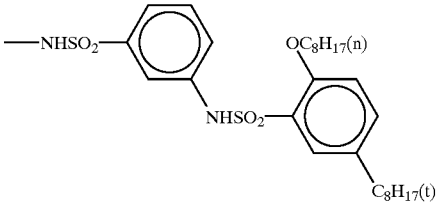
BAL-26
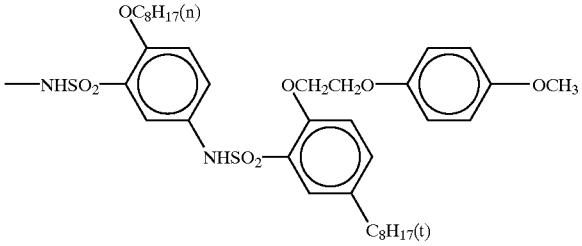
BAL-27
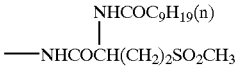

-continued
BAL-28
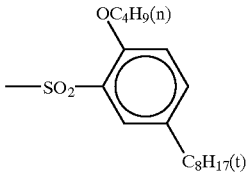
BAL-29
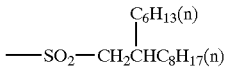
BAL-30
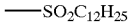
LVG-1
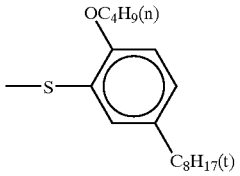
(M-1)
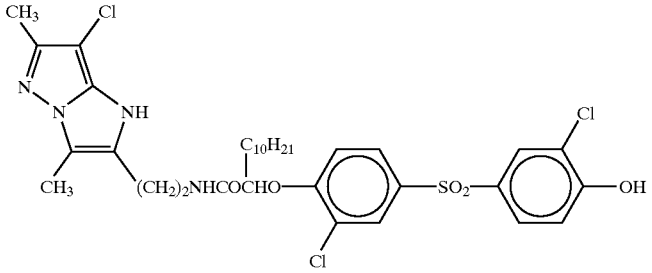
(M-2)
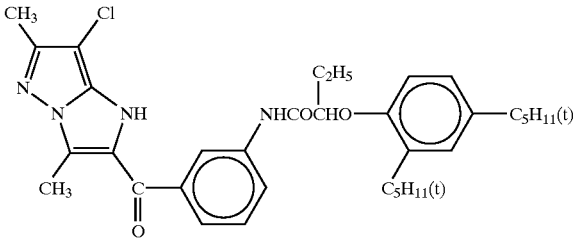
(M-3)
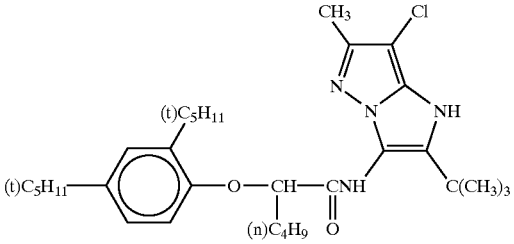

-continued
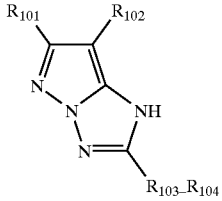
| No. | $R_{101}$ | $R_{102}$ | $R_{103}$ | $R_{104}$ |
|---|---|---|---|---|
| (M-4) | $CH_3$— | Cl | *—CH(CH$_3$)CH$_2$— | BAL-2 |
| (M-5) | $CH_3$— | Cl | *—CH(CH$_3$)CH$_2$— | BAL-17 |
| (M-6) | $CH_3$— | Cl | *—CH(CH$_3$)—CH$_2$— | BAL-16 |
| (M-7) | $CH_3$— | Cl | *—CH(CH$_3$)CH$_2$— | BAL-18 |
| (M-8) | $(CH_3)_3C$— | Cl | * 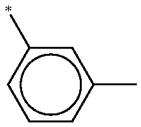 | BAL-14 |
| (M-9) | $CH_3$— | Cl | *—C(CH$_3$)$_2$—CH$_2$— | BAL-14 |
| (M-10) | $C_2H_5O$— | LVG-1 | *—$CH_2CH_2$— | BAL-24 |
| (M-11) | 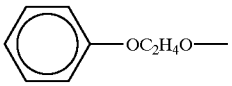 | LVG-1 | *—CH(CH$_3$)CH$_2$— | BAL-24 |
| (M-12) | 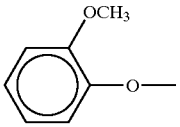 | —Cl | *—CH(CH$_3$)CH$_2$— | BAL-22 |
| (M-13) | $(CH_3)_2CHO$— | LVG-1 | — | 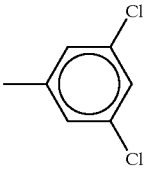 |
| (M-14) | 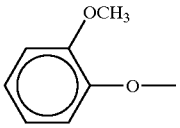 | LVG-1 | * 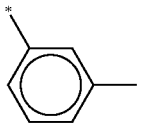 | BAL-14 |
| (M-15) | O‖ $(CH_3)_2NCNH$— | Cl | *—CH(CH$_3$)CH$_2$— | BAL-23 |

-continued
| | | | | |
|---|---|---|---|---|
| (M-16) | $(CH_3)_2CH$— | 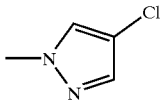 | *—$CH(CH_3)CH_2$— | BAL-4 |
| (M-17) | $CH_3$— | 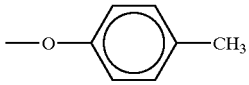 | *—$CH(CH_3)CH_2$— | BAL-1 |
| (M-18) | 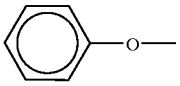 | Cl | 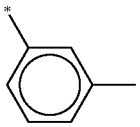 | BAL-2 |
| (M-19) | $CH_3$— | Cl | *—$CH(CH_3)CH_2$— | BAL-20 |
| (M-20) | $CH_3$— | Cl | 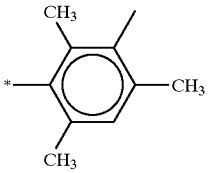 | BAL-12 |
| (M-21) | $(CH_3)_3C$— | H | —$C(CH_3)_2CH_2$— | BAL-16 |
| (M-22) | $(CH_3)_2CH$— | Cl | *—$C(CH_3)_2CH_2$— | BAL-18 |
| (M-23) | $C_2H_5$— | 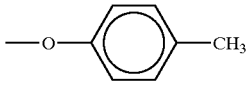 | *—$CH(CH_3)CH_2$— | BAL-6 |
| (M-24) | $C_2H_5$— | 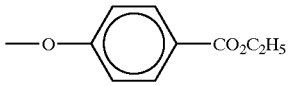 | *—$CH(CH_3)CH_2$— | BAL-17 |
| (M-25) | $(CH_3)_2CH$— | 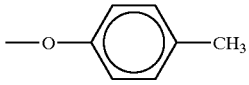 | *—$C(CH_3)_2CH_2$— | BAL-3 |
| (M-26) | $(CH_3)_3C$— | 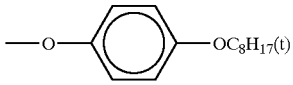 | *—$C(CH_3)_2CH_2$— | BAL-15 |
| (M-27) | 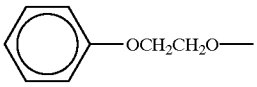 | 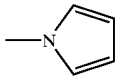 | *—$CH(CH_3)CH_2$— | BAL-21 |
| (M-28) | 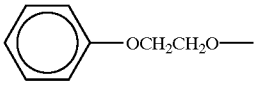 | LVG-1 | 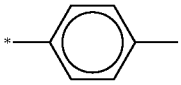 | BAL-23 |
| (M-29) | 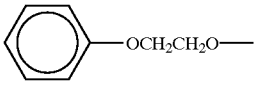 | LVG-1 | 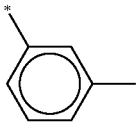 | BAL-18 |
| (M-30) | 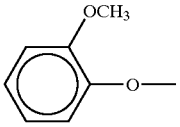 | Cl | 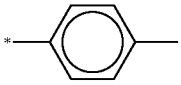 | BAL-22 |

-continued
| | | | | |
|---|---|---|---|---|
| (M-31) | 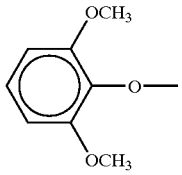 | 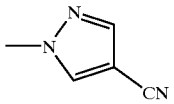 | 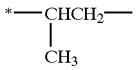 | BAL-22 |
| (M-32) | 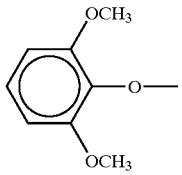 | 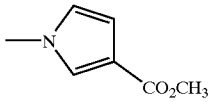 | 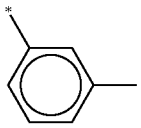 | BAL-14 |
| (M-33) | 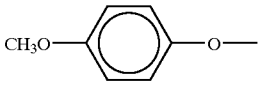 | 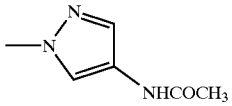 | 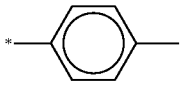 | BAL-18 |
| (M-34) | $(CH_3)_3C$— | 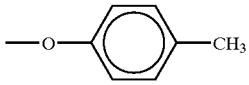 | 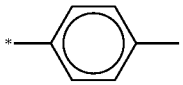 | BAL-10 |
| (M-35) | 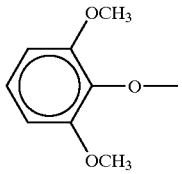 | Cl | 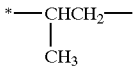 | BAL-27 |
| (M-36) | 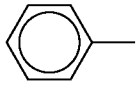 | Cl | 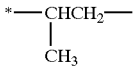 | BAL-8 |
| (M-37) | 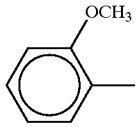 | Cl | *—$(CH_2)_3$— | BAL-12 |
| (M-38) | $(CH_3)_3C$— | Cl | 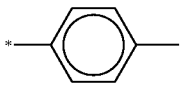 | BAL-11 |
| (M-39) | $(CH_3)_3C$— | Cl | 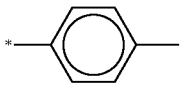 | BAL-12 |
| (M-40) | $(CH_3)_3C$— | Cl | 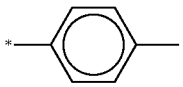 | BAL-13 |
| (M-41) | $(CH_3)_3C$— | Cl | 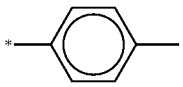 | BAL-10 |
| (M-42) | $(CH_3)_3C$— | Cl | 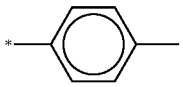 | BAL-27 |

-continued
| | | | | |
|---|---|---|---|---|
| (M-43) | $(CH_3)_3C$— | Cl | 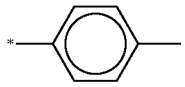 | BAL-7 |
| (M-44) | $(CH_3)_3C$— | F | 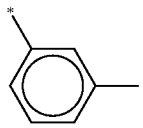 | BAL-14 |
| (M-45) | $(CH_3)_3C$— | Cl | 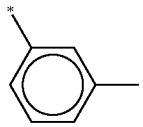 | BAL-9 |
| (M-46) | $(CH_3)_3C$— | Cl | *—$CH(CH_3)CH_2$— | BAL-4 |
| (M-47) | $(CH_3)_3C$— | Cl | *—$CH(CH_3)CH_2$— | BAL-25 |
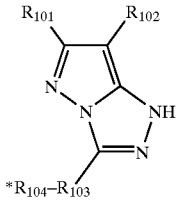
| No. | $R_{101}$ | $R_{102}$ | $R_{103}$ | $R_{104}$ |
|---|---|---|---|---|
| (M-48) | $CH_3$— | Cl | *—$(CH_2)_3$— 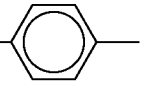 | BAL-9 |
| (M-49) | $CH_3$— | Cl | *—$(CH_2)_3$— 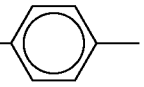 | BAL-15 |
| (M-50) | $CH_3$— | Cl | *—$CH_2CH_2$— | BAL-29 |
| (M-51) | $(CH_3)_2CH$— | Cl | *—$(CH_2)_3$— | BAL-28 |
| (M-52) | $CH_3$— | Cl | *—CH($C_{12}H_{25}$(n))—O— 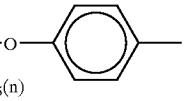 | —$NHSO_2$— 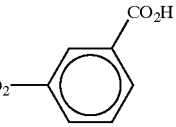 ($CO_2H$) |
| (M-53) | $CH_3$— | Cl | *—$CH(CH_3)$— | BAL-18 |
| (M-54) | $CH_3$ | Cl | 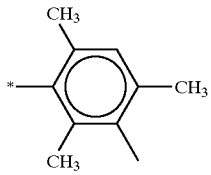 | BAL-5 |

-continued
| | | | | |
|---|---|---|---|---|
| (M-55) | $(CH_3)_3C$— | Cl | 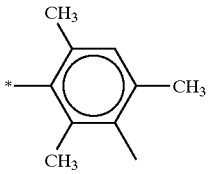 | —$NHCOC_{12}H_{25}(n)$ |
| (M-56) | $C_2H_5$— | 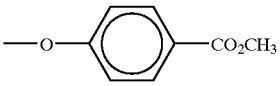 | *—$CH(CH_3)$— | BAL-23 |
| (M-57) | $C_2H_5$— | 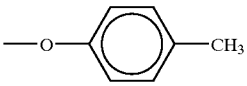 | *—$C(CH_3)_2$— | BAL-22 |
| (M-58) | $(CH_3)_3C$— | Cl | *—$C(CH_3)_2$— | BAL-16 |
| (M-59) | $(CH_3)_2CH$— | 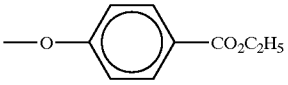 | 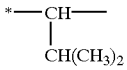 | BAL-19 |
| (M-60) | $C_2H_5$— | 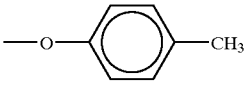 | *—$CH(CH_3)$— | BAL-26 |
| (M-61) | $CH_3$— | Cl | 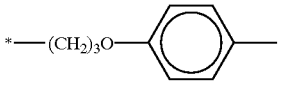 | BAL-3 |
| (M-62) | $(CH_3)_3C$— | Cl | 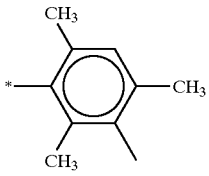 | BAL-9 |
| (M-63) | $(CH_3)_3C$— | Cl | *—$(CH_2)_3$— | BAL-30 |
| (M-64) | $CH_3$— | Cl | 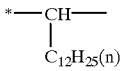 | 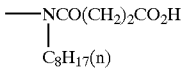 |
| (M-65) | $CH_3$— | Cl | 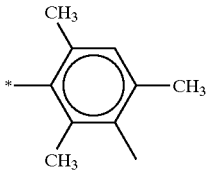 | BAL-27 |
| (M-66) | $CH_3$— | 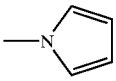 | *—$CH(CH_3)$— | BAL-2 |
| (M-67) | $(CH_3)_3C$— | H | 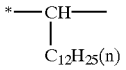 | 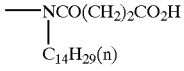 |

-continued
(M-68)
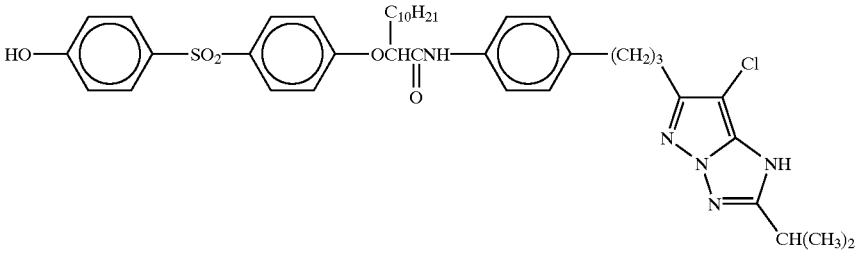
(M-69)
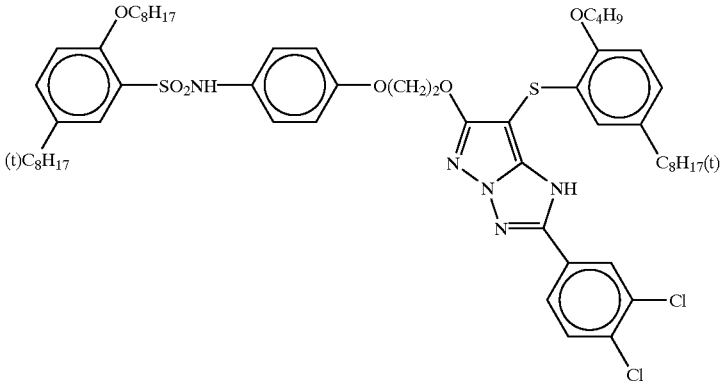
(M-70)
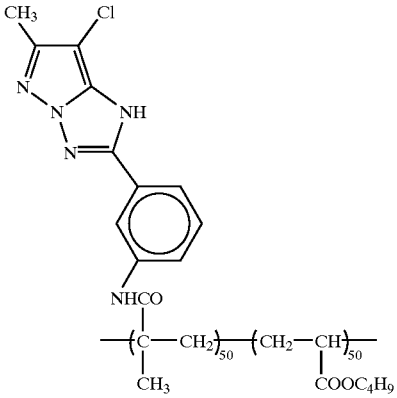
(M-71)
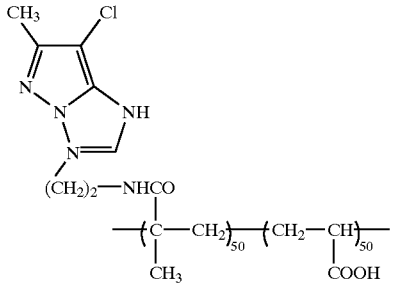

-continued
(M-72)
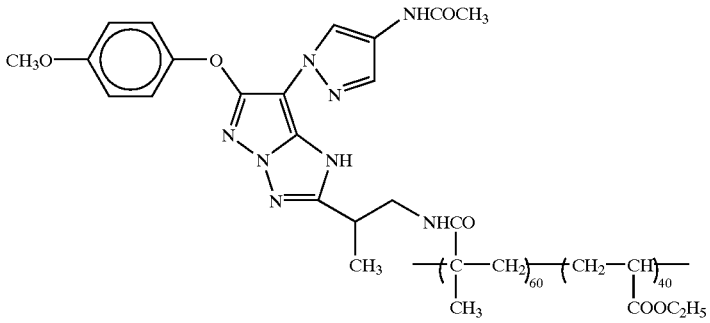
(M-73)
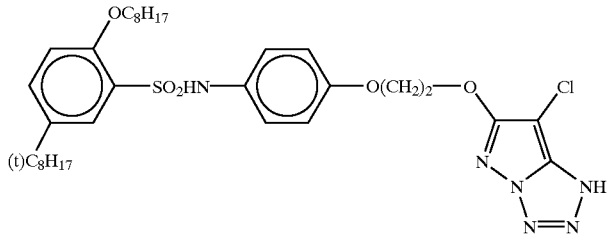
(M-74)
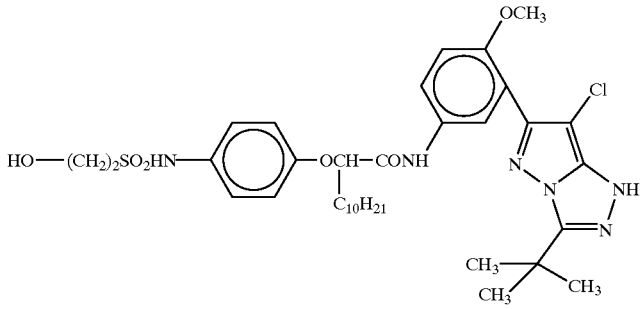
(M-75)
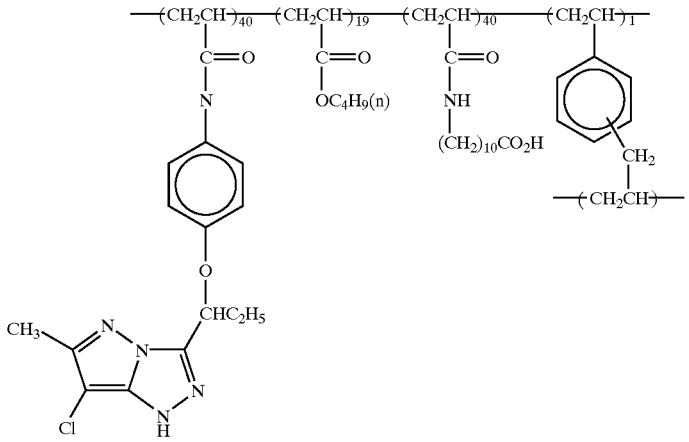

-continued
(M-76)
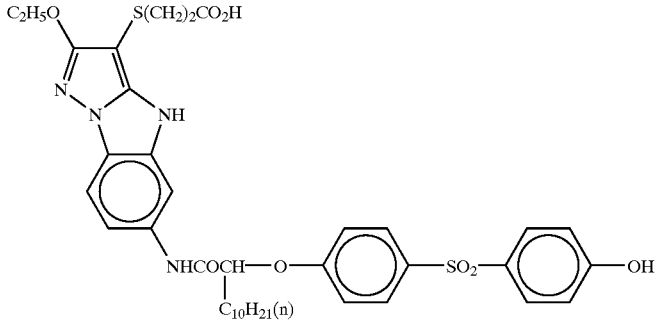
(M-77)
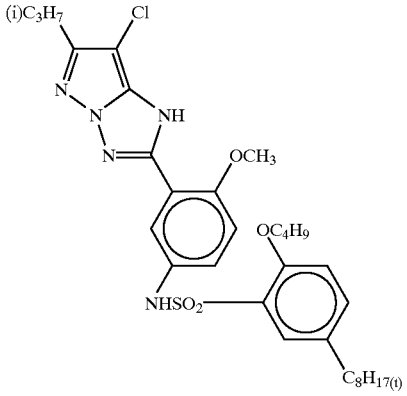
(M-78)
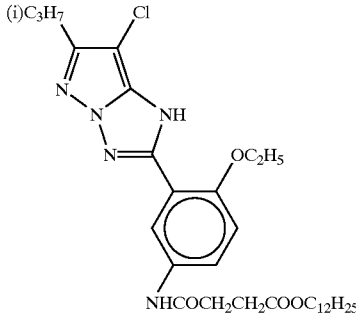
(M-79)
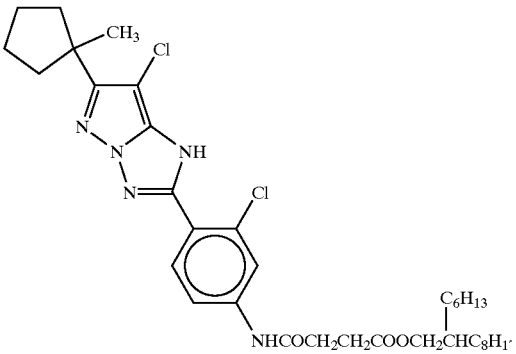

-continued
(M-80)
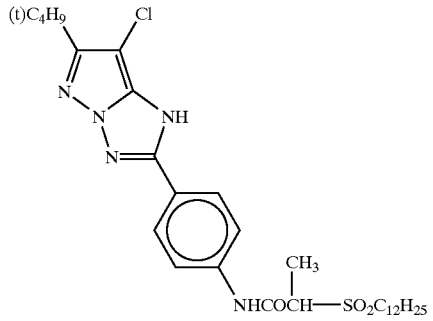
(M-81)
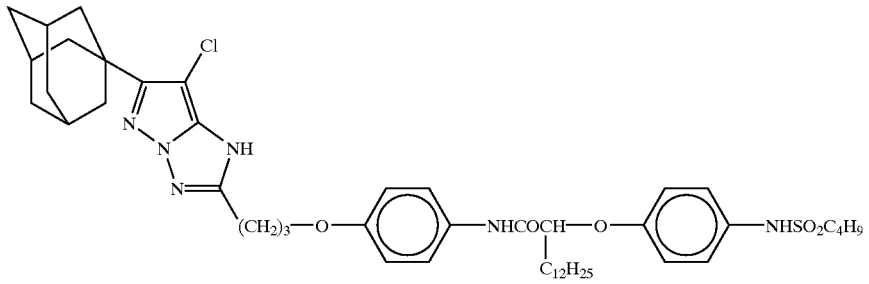
(M-82)
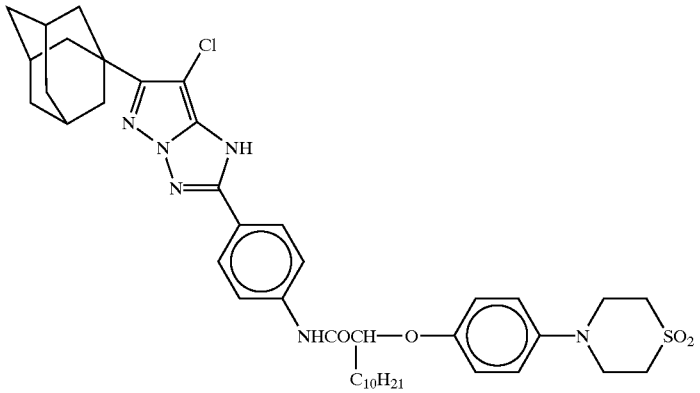
(M-83)
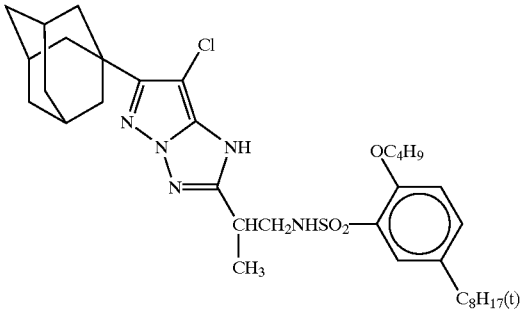

-continued
(M-84)
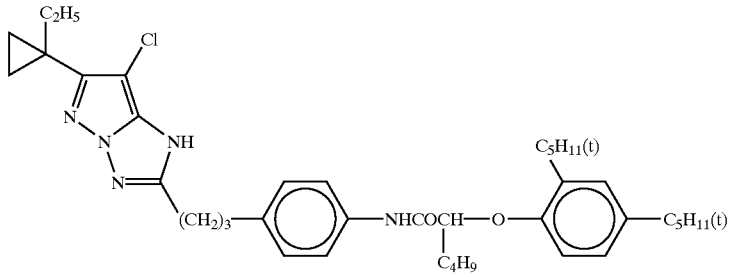
(M-85)
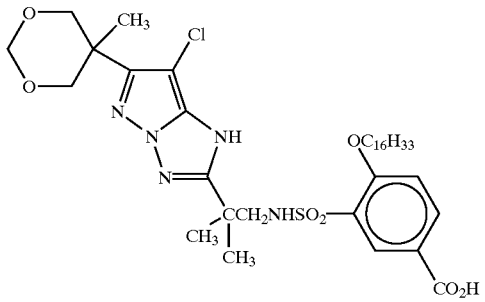
(M-86)
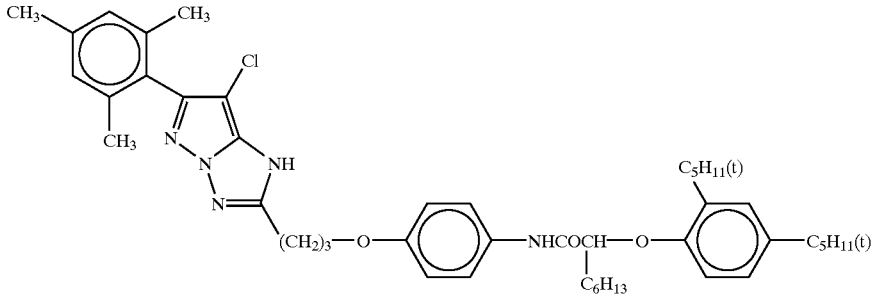
(M-87)
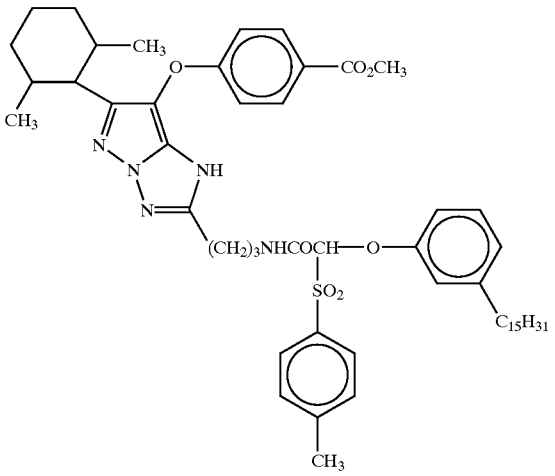

-continued
(M-88)
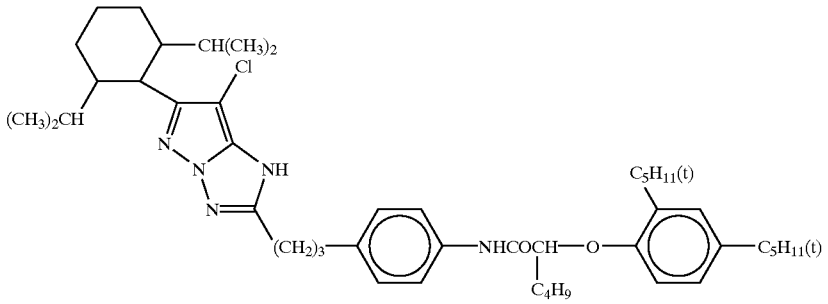
(M-89)
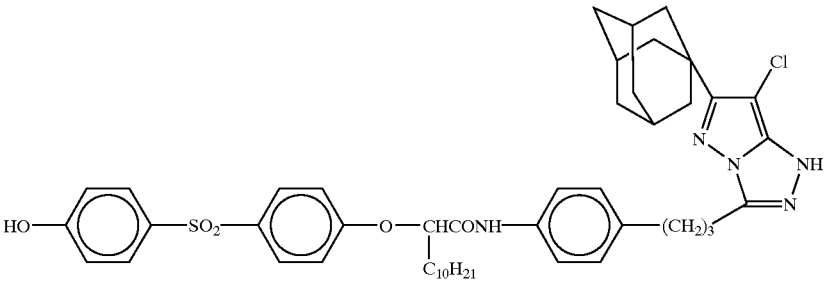
(M-90)
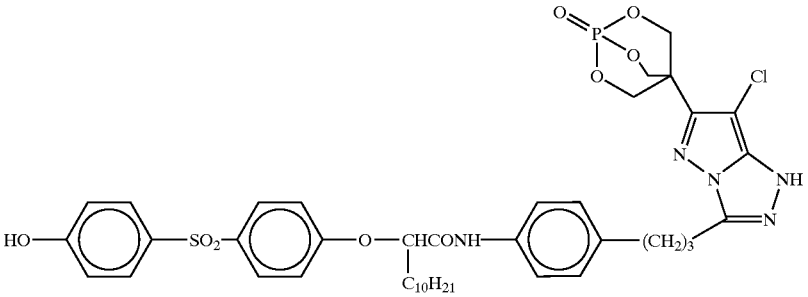
(M-91)
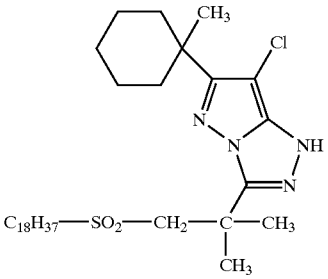

-continued
(M-92)
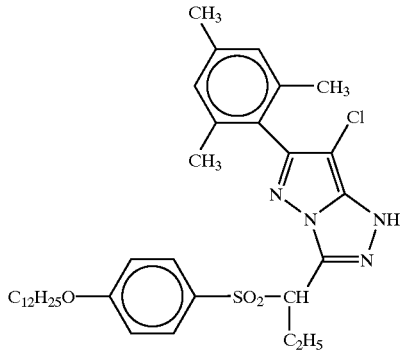
(M-93)
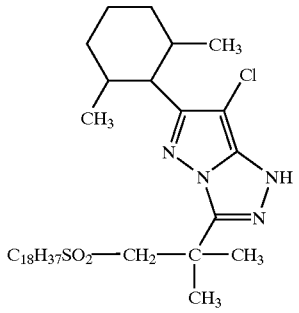
(M-94)
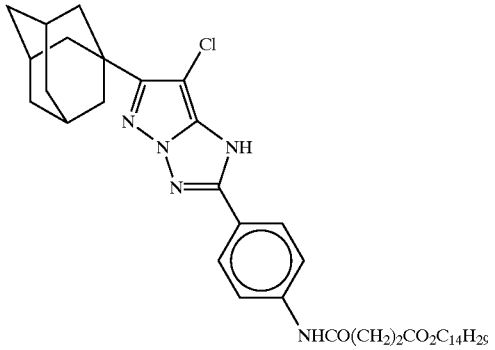
(M-95)
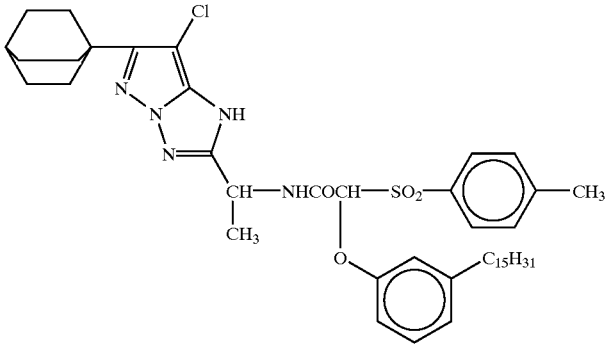

-continued
(M-96)
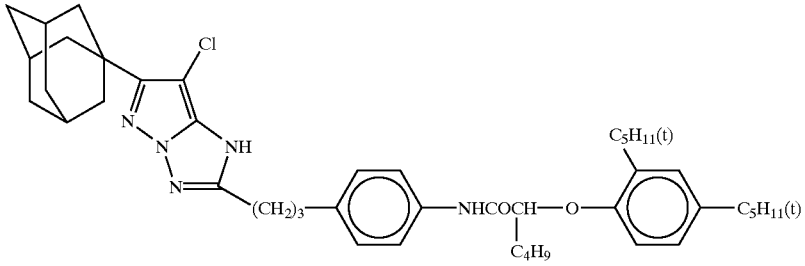
(M-97)
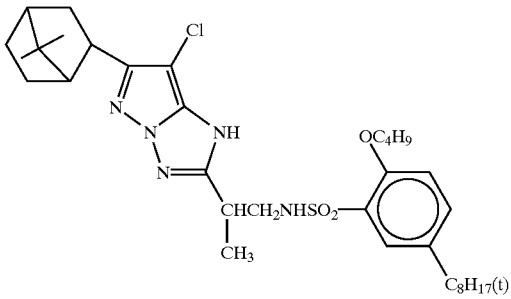
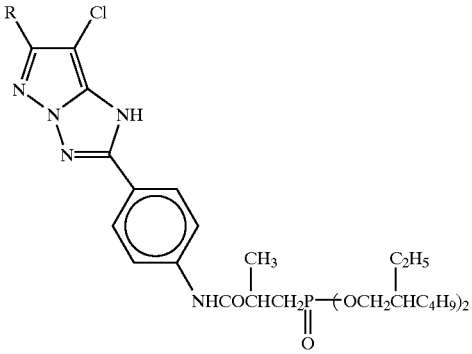
(M-98)
R = $CH_3$
(M-99)
R = $C_4H_9$(t)
(M-100)
R =
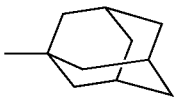
(M-101)
R =
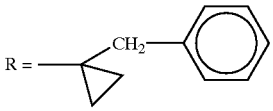

-continued
(M-102)
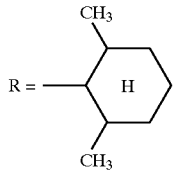
(M-103)
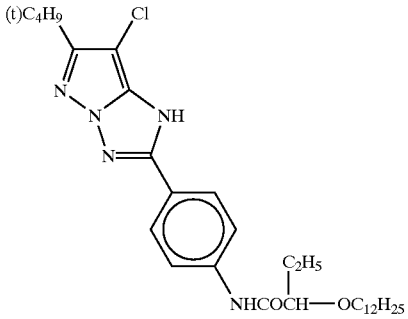
(M-104)
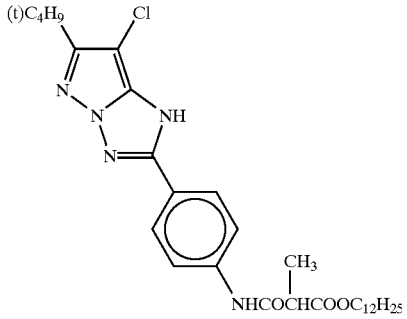
(M-105)
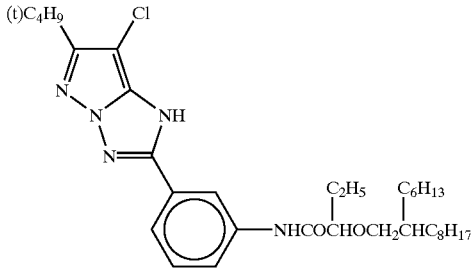

-continued
(M-106)
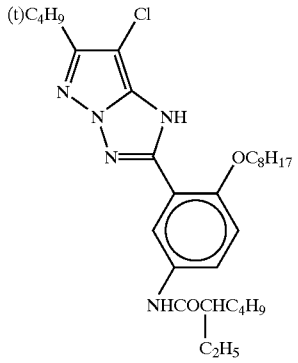
(M-107)
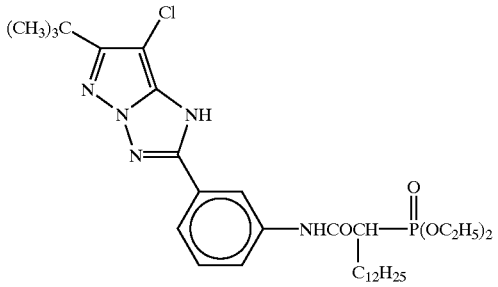
(M-108)
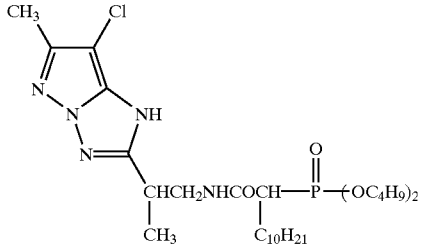
(M-109)
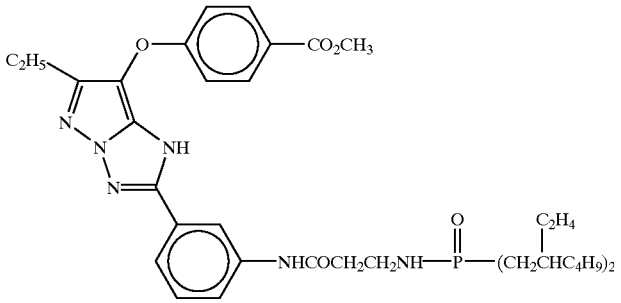

-continued
(M-110)
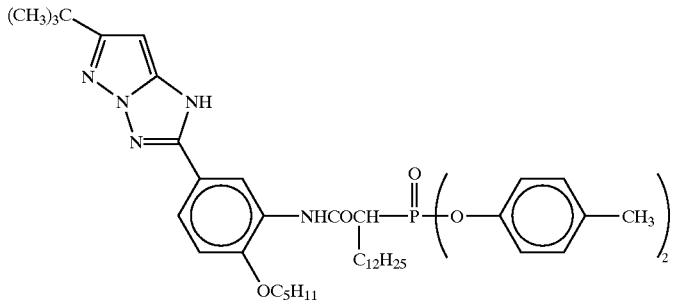
(M-111)
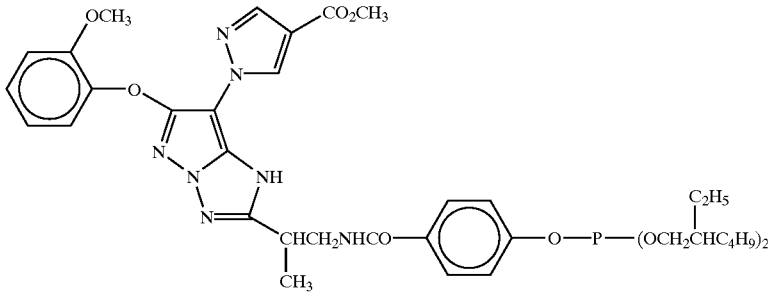
(M-112)
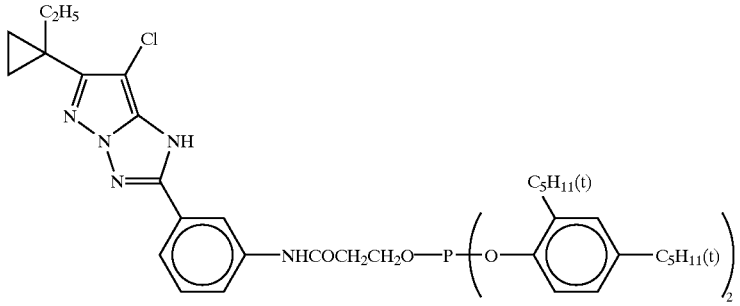
(M-113)
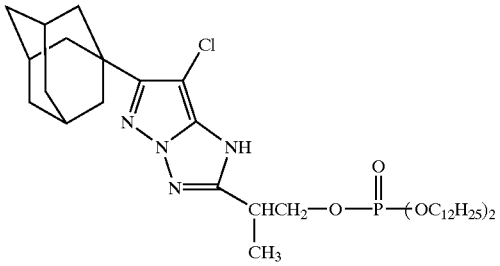

-continued
(M-114)
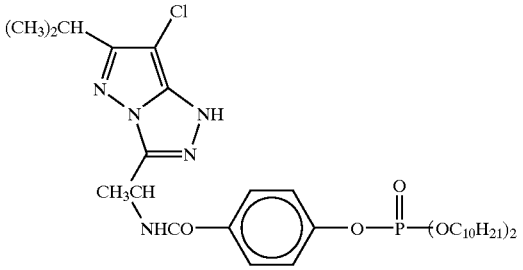
(M-115)
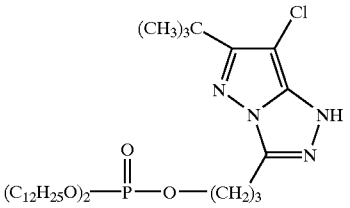
(M-116)
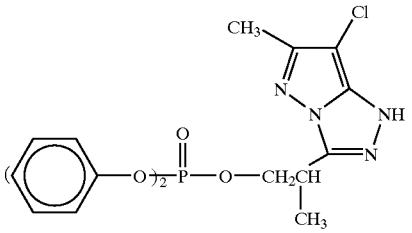
(M-117)
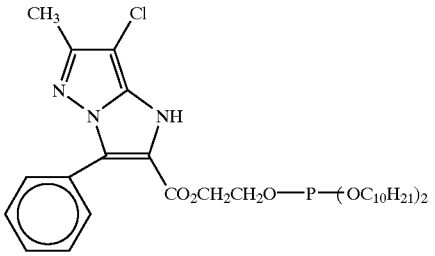
(M-118)
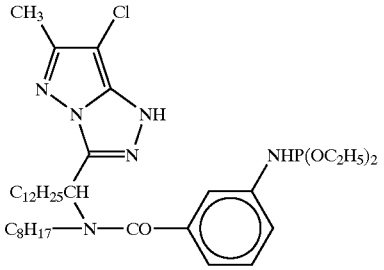

-continued (M-119)

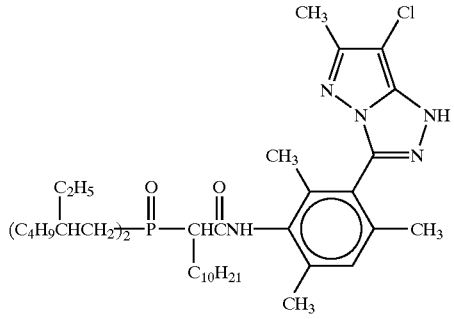

The high boiling organic solvent of the present invention may be any one as long as it is a high boiling organic solvent having a dielectric constant of 6.0 or less and a refraction index of 1.50 or less. Those having a solubility of 1% or less to water are preferred for a purpose of emulsifying and dispersing a coupler in a gelatin aqueous solution. The dielectric constant preferred in terms of shifting to a shorter wavelength is 5.5 or less, further preferably 3.0 or more and 5.0 or less. With respect to an effect of improving a turbidity in a coated film, since the high boiling organic solvent having the refraction index of 1.48 or less increases the turbidity in the coated film, the effect of improving the turbidity in the present invention is increased as well and it is preferred. The high boiling organic solvent may be of any form of liquid, wax and a solid matter at an ordinary temperature. In the case where it is the solid at the ordinary temperature, it has a melting point of 150° C. or lower, preferably 100° C. or lower. Further, the high boiling organic solvent has preferably a boiling point of 170° C. or higher at the ordinary temperature.

A lower limit of the refraction index of the high boiling organic solvent which can be used in the present invention is not particularly limited, and one having that of 1.40 or more is easy to obtain practically.

The high boiling organic solvent according to the present invention can be used in a mixture of two or more kinds. In this case, they may be any ones as long as the dielectric constant and the refraction index thereof each obtained by a weighed average based on a weight composition may fall within the regulated range.

If the conditions described above are satisfied, a structure is not limited, and the high boiling organic solvent which is preferably used is selected from phosphoric acid esters, phosphonic acid esters, benzoic acid esters, phthalic acid esters, fatty acid esters, carbonic acid esters, amides, ethers, hydrogen halides, alcohols, and paraffins. Of them, it is particularly preferably selected from phosphoric acid esters, phosphonic acid esters, phthalic acid esters, benzoic acid esters, and fatty acid esters.

The concrete examples of the high boiling organic solvent according to the present invention will be shown below but naturally will not be limited thereto.

| | High Boiling Organic Solvent | Dielectric Constant | Refraction Index |
|---|---|---|---|
| S-1 | $P(=O)(OC_6H_{13})_3$ | 5.86 | 1.433 |
| S-2 | $P(=O)(OCH_2CH(C_2H_5)C_4H_9)_3$ | 4.80 | 1.4419 |
| S-3 | $P(=O)(OC_8H_{17})_3$ | 4.95 | 1.4408 |
| S-4 | $P(=O)(OCH_2CH_2CH(CH_3)CH_2C(CH_3)_3)_3$ | 4.46 | 1.447 |
| S-5 | $P(=O)(OC_{12}H_{25})_3$ | 3.87 | 1.4507 |

-continued
| | High Boiling Organic Solvent | Dielectric Constant | Refraction Index |
|---|---|---|---|
| S-6 | 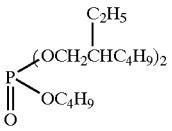 | 5.65 | 1.440 |
| S-7 | 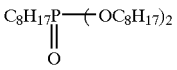 | 4.16 | 1.4477 |
| S-8 | 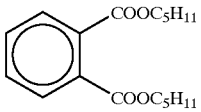 | 5.91 | 1.488 |
| S-9 | 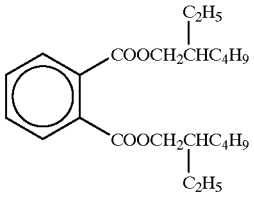 | 5.18 | 1.485 |
| S-10 | 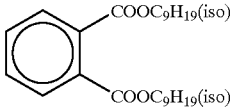 | 4.62 | 1.4810 |
| S-11 | 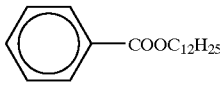 | 3.92 | 1.4832 |
| S-12 | 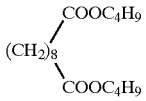 | 4.47 | 1.4391 |
| S-13 | 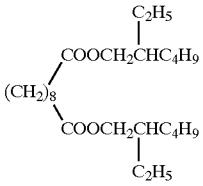 | 3.96 | 1.4491 |
| S-14 | 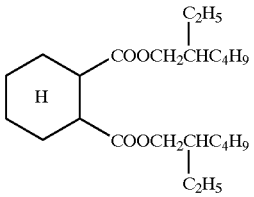 | 4.43 | 1.4611 |
| S-15 | 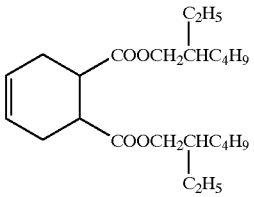 | 4.34 | 1.465 |

-continued
| | High Boiling Organic Solvent | Dielectric Constant | Refraction Index |
|---|---|---|---|
| S-16 | 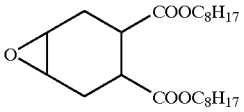 | 5.37 | 1.4648 |
| S-17 | 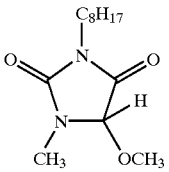 | 4.16 | 1.4637 |
| S-18 | $CH_2—OCOCH(C_2H_5)C_4H_9$<br>\| <br>$CH—OCOCH(C_2H_5)C_4H_9$<br>\| <br>$CH_2—OCOCH(C_2H_5)C_4H_9$ | 4.28 | 1.4442 |
| S-19 | 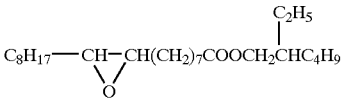 | 4.85 | 1.454 |
| S-20 | 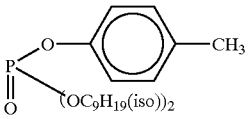 | 5.23 | 1.4564 |
| S-21 | 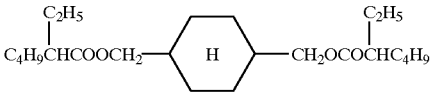 | 3.84 | 1.4548 |
| S-22 | 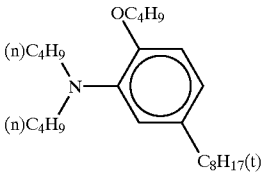 | 2.76 | 1.490 |
| S-23 | 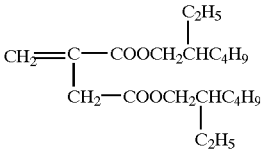 | 4.63 | 1.4500 |
| S-24 | $C_8H_{17}O—C(=O)—OC_8H_{17}$ | 2.38 | 1.4385 |
| S-25 | $P—(OC_{12}H_{25})_3$ | 3.49 | 1.4554 |
| S-26 | $CH_2COOC_4H_9$<br>\| <br>$CH—COOC_4H_9$<br>\| <br>$CH_2—COOC_4H_9$ | 5.19 | 1.433 |

-continued

| | High Boiling Organic Solvent | Dielectric Constant | Refraction Index |
|---|---|---|---|
| S-27 | $(CH_2)_4(COOCH_2CH(C_2H_5)C_4H_9)_2$ | 4.23 | 1.447 |
| S-28 | $C_{13}H_{27}COOCH_2CH(C_6H_{13})C_8H_{17}$ | 2.89 | 1.453 |
| S-29 | $CH_3CH(OH)COOC_{18}H_{37}$(iso) | 4.48 | 1.4493 |

The water insoluble polymer according to the present invention is a polymer which contains a monomer unit having at least one aromatic group as the constitutional element thereof and is substantially insoluble in water. A vinyl monomer is preferred as the monomer. A number-average molecular weight of the water insoluble polymer according to the present invention is suitably 200,000 or less, preferably 20,000 or less, and more preferably 10,000 or less. The most preferred one in terms of that the polymer according to the present invention does not prevent a coupling of a coupler with an oxidation product of a color developing agent to damage a color developability is the polymer which has the number-average molecular weight falling within a range of 1000 to 5000. The polymer according to the present invention may be either a so-called homopolymer consisting of a one kind of a monomer or a copolymer consisting of two or more kinds of the monomers. In the case where it is the copolymer, the monomer having an aromatic group according to the present invention is preferably contained by 50% or more.

A structure of the polymer is not particularly limited if the conditions described above are satisfied. The preferred structure includes a polymer having a repetitive unit which is derived from styrene, α-methylstyrene, β-methylstyrene or monomers obtained by providing substituents on these rings and a polymer having a repetitive unit which is derived from aromatic acrylamide, aromatic methacrylamide, aromatic acrylic ester, or aromatic methacrylic ester.

Of them, the polymer which is derived from styrene, α-methylstyrene or β-methylstyrene is preferred in terms of easiness to obtain it and an aging stability of an emulsion.

The concrete examples of the water insoluble polymer according to the present invention will be listed below but naturally will not be limited thereto.

P-1

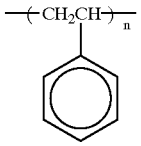

-continued

P-2

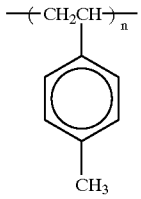

P-3

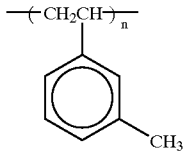

P-4

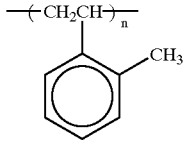

P-5

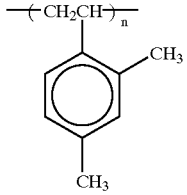

P-6

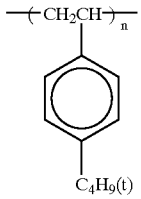

P-7

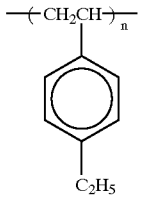

-continued
P-8
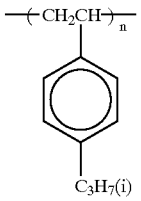
P-9
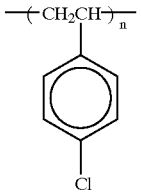
P-10
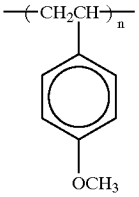
P-11
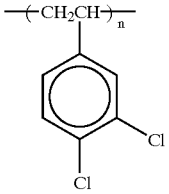
P-12
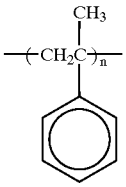
P-13
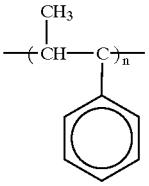
P-14
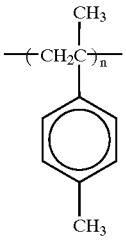
P-15
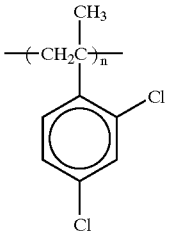
-continued
P-16
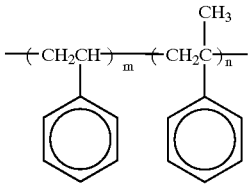
P-17
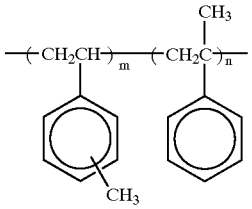
P-18
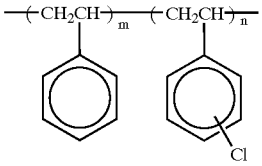
P-19
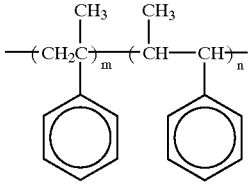
P-20
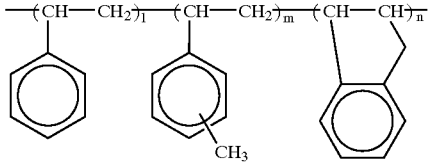
P-21
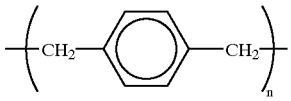
P-22
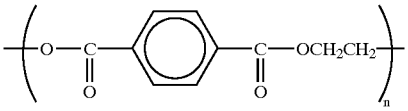
P-23
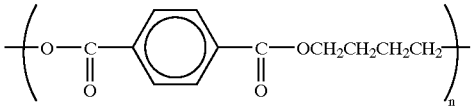
P-24
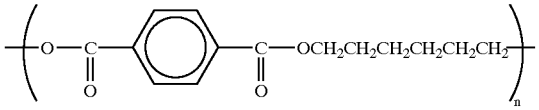
P-25
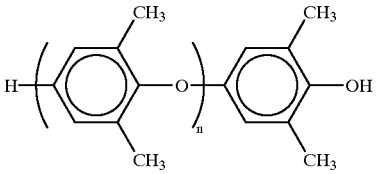

-continued
P-26
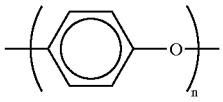
P-27
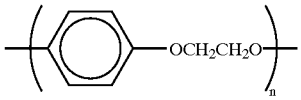
P-28
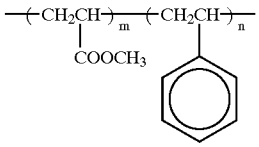
P-29
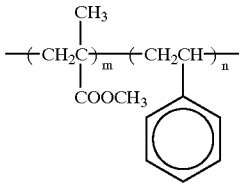
P-30
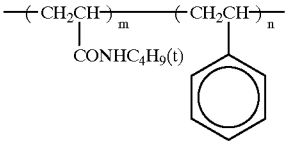
P-31
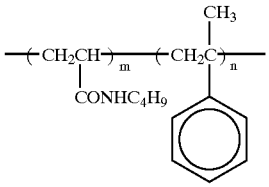
P-32
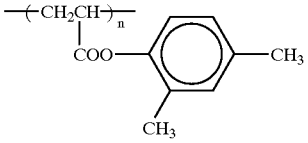
P-33
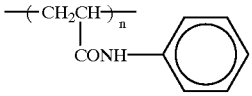
P-34
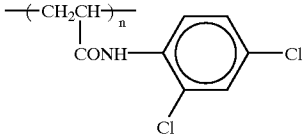
P-35
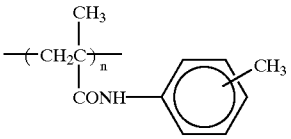
P-36
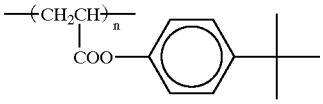
-continued
P-37
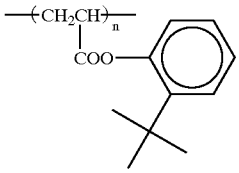
P-38
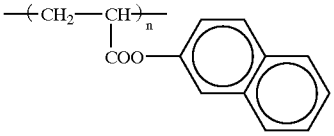
P-39
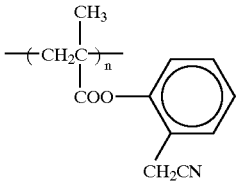
P-40
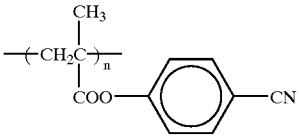
P-41
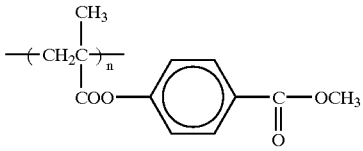
P-42
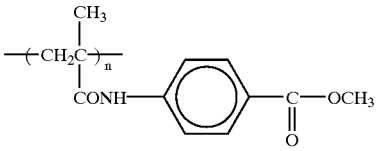
P-43
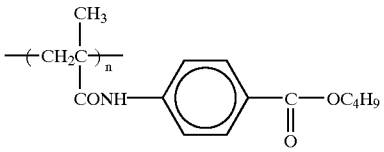
P-44
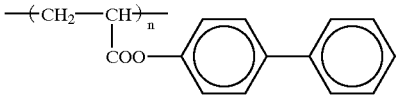
P-45
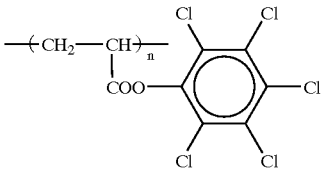
P-46
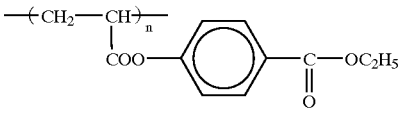

-continued

P-47

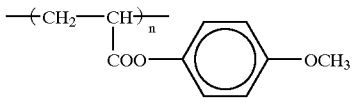

P-48

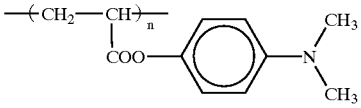

P-49

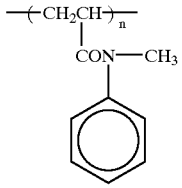

P-50

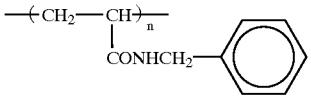

P-51

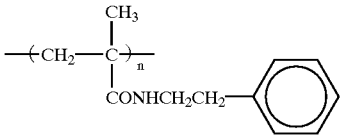

P-52

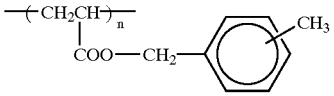

P-53

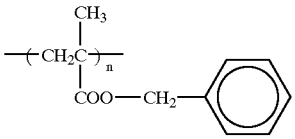

P-54

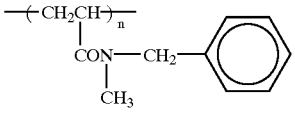

P-55

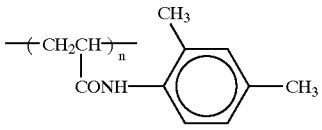

P-56

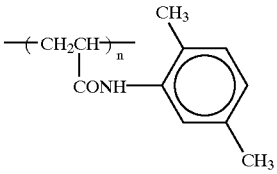

P-57

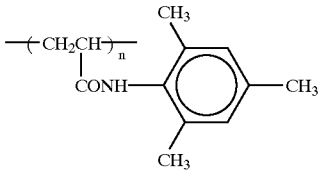

-continued

P-58

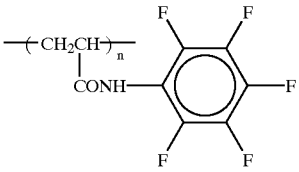

P-59

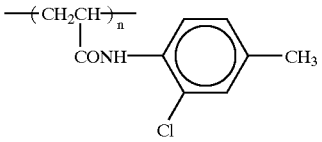

P-60

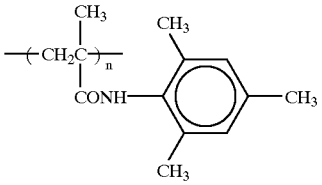

P-61

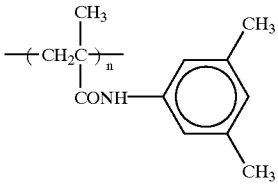

P-62

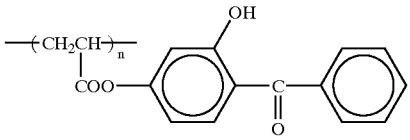

P-63

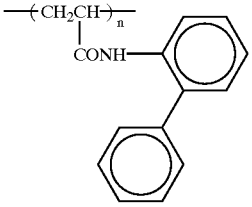

P-64

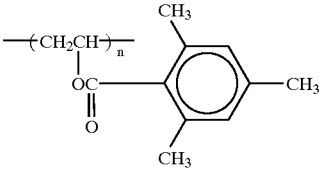

In the case where the magenta coupler of the present invention is applied to a silver halide color photographic light-sensitive material, it is preferably used in a green-sensitive silver halide emulsion layer.

A preferred use amount of the magenta coupler of the present invention represented by Formula (M) in the silver halide color photographic light-sensitive material falls within a range of 0.01 to 10 mmole/$m^2$, more preferably 0.05 to 5 mmole/$m^2$, and most preferably 0.1 to 2 mmole/$m^2$. Of course, the coupler of Formula (M) may be used in combination of two or more kinds, wherein the coupler which is used in combination may be a coupler other than that of Formula (M). In this case, a use rate of the coupler of the present invention is preferably 50 mole % or more.

A preferred use amount of silver halide in a silver halide emulsion layer in which the coupler of the present invention is used in a range of 0.5 to 50 times, preferably 1 to 20 times, and most preferably 2 to 10 times as much as the coupler in terms of mole.

The high boiling organic solvent according to the present invention falls suitably in a range of 0.2 to 10.0, preferably 0.5 to 8.0, and more preferably 1.0 to 6.0 based on the magenta coupler of the present invention in terms of a weight ratio.

The water insoluble polymer according to the present invention is used preferably in a range of 0.05 to 5.0 based on the magenta coupler of the present invention in terms of a weight ratio. More preferred range is 0.1 to 3.0, and the range of 0.2 to 1.5 is further preferred.

In the present invention, with respect to a process for adding the above coupler to a hydrophilic colloid layer, it can usually be added according to an oil-in-water dispersion process which is publicly known as an oil protect process. That is, it is a process in which after the coupler is dissolved in the high boiling organic solvent which is used in the present invention and a low boiling auxiliary solvent, it is dispersed in a gelatin aqueous solution containing a surface active agent. Or, water or a gelatin aqueous solution may be added to a coupler solution containing a surface active agent to prepare an oil-in-water dispersion accompanied with a phase conversion.

In an alkali soluble coupler, a dispersion process which is known as the Fisher dispersion process can be used as well. In order to remove a low boiling organic solvent from the dispersion thus prepared, a process such as a distillation, a noodle washing, or a ultrafiltration can be preferably used as well.

Further, there can be used as well a process in which an oil soluble coupler is dissolved in an alkaline solution together with a water miscible organic solvent and this is neutralized in the presence of a surface active agent to obtain a fine dispersion, as described in, for example, European Patents EP-0477271B, EP-0454775B and EP-0374837A.

Esters such as ethyl acetate, alcohols such as methanol and ethanol, and ketones such as acetone are preferably used as the above low boiling auxiliary solvent which is used for dissolving the coupler.

Each at least one yellow color developing silver halide emulsion layer, magenta color developing silver halide emulsion layer and cyan color developing silver halide emulsion layer is provided on a support to thereby constitute the color light-sensitive material of the present invention. In a general color photographic paper, the color coupler which forms a dye having a relationship of a complementary color with rays to which a silver halide emulsion is sensitive can be incorporated to carry out a color reproduction by a subtractive color process.

In the general color photographic paper, the silver halide emulsion grains are spectrally sensitized with the blue-sensitive, green-sensitive and red-sensitive spectral sensitizing dyes, respectively, in order of the above color developing layers, and the respective emulsions can be coated on the support in the above order to constitute the color photographic paper. However, the order may be different from this. That is, the light-sensitive emulsion layer containing the silver halide grains with the largest average grain size is preferably provided on an uppermost layer in some cases from a viewpoint of a rapid processing, and the lowest layer is preferably a magenta color developing light-sensitive emulsion layer in some cases from a viewpoint of a storing performance under irradiation of rays.

There may be taken d constitution in which the light-sensitive layers and the hues of developed colors have no above correspondence, and at least one infrared-sensitive silver halide emulsion layer can be used as well.

The support used in the present invention may be any support such as glass, paper and a plastic film as long as it is a support on which a photographic emulsion layer can be coated. A reflection type support is most preferred.

The "reflection type support" used in the present invention means that which raises a reflectivity to make a dye image formed in a silver halide emulsion layer clear. Such the reflection type support includes that obtained by coating a light reflective material such as titanium oxide, zinc oxide, calcium carbonate, and calcium sulfate on the support and that in which a hydrophobic resin itself containing the dispersed light reflective material is used as the support. It includes, for example, a polyethylene-coated paper, a polyethylene terephthalate-coated paper, a polypropylene series synthetic paper, a transparent support on which a reflecting layer is provided or in which the reflective material is used, for example, a glass plate and a polyester film such as polyethylene terephthalate, cellulose triacetate or cellulose nitrate, a polyamide film, a polycarbonate film, a polystyrene film, and a vinyl chloride resin.

The reflecting type support used in the present invention is a paper support which is coated on the both sides thereof with an anti-water resin layer, and at least either one of the anti-water resin layers contains preferably white pigment fine particles. This white pigment particle is contained preferably in a density of 12 weight % or more, more preferably 14 weight % or more. With respect to a light reflective white pigment particle, the white pigment is preferably sufficiently kneaded, and those obtained by treating a surface of the pigment particle with di- to tetrahydric alcohol is preferably used.

It is preferred that the white pigment fine particles do not form an aggregate of the particles in a reflecting layer and are evenly dispersed. A size of the distribution thereof can be determined by measuring an occupied area ratio (%) (Ri) of the fine particles which are projected on a unit area. A variation coefficient of the occupied area ratio (%) can be determined by a ratio s/R of a standard deviation s of Ri to an average value (R) of Ri. In the present invention, the variation coefficient in the occupied area ratio (%) of the fine particles of the pigment is preferably 0.15 or less, more preferably 0.12 or less, and particularly preferably 0.08 or less.

In the present invention, a support having a surface of a class 2 diffusion reflectivity can preferably be used. The class 2 diffusion reflectivity means a diffusion reflectivity obtained by giving an unevenness to a surface having a mirror face to divide it into fine mirror faces each turning to a different direction and dispersing a direction of a divided fine surface (a mirror face). An unevenness on a surface of the class 2 diffusion reflectivity has a three dimensional average roughness to a center face of 0.1 to 2 mm, preferably 0.1 to 1.2 mm. A frequency of the unevenness on the surface is preferably 0.1 to 2000 cycles/mm, further preferably 50 to 600 cycles/mm for the unevenness with the roughness of 0.1 mm or more. The details of such the support are described in JP-A-2-239244 (the term "JP-A" as used herein means an unexamined published Japanese patent application).

In the present invention, the silver chlorobromide, silver chloroiodobromide or silver chloride grains each having a silver chloride content of 95 mole % or more are preferably used as the silver halide grains. In particular, in the present invention, silver halide comprising silver chlorobromide or silver chloride containing substantially no silver iodide can be preferably used in order to accelerate a development processing time, wherein the term "containing substantially no silver iodide" means that a silver iodide content is 1 mol % or less, preferably 0.2 mol % or less. Meanwhile, the high silver chloride grains containing silver iodide of 0.01 to 3 mol % on an emulsion surface as described in JP-A-3-84545 are preferably used in some cases for the purposes of increasing a sensitivity at a high illuminance, raising a spectral sensitization sensitivity and improving an aging stability of a light-sensitive material. A halogen composition of an emulsion may be different or equivalent by grain. Use of the emulsion containing the grains each having the same composition can readily homogenize a quality of each of the grains. With respect to a halogen composition distribution in an inside of a silver halide emulsion grain, there can suitably be selected and used the grains of a so-called homogeneous type structure in which the composition is the same at any part of the silver halide grain, the grains of a so-called laminating type structure in which a core present in the inside of the silver halide grain and a shell (one layer or plural layers) surrounding it have the different halogen compositions, or the grains of a structure in which there are present the portions having the different halogen compositions in an inside or on a surface of the grain in a form of a non-layer (a structure in which the portions of the different compositions are conjugated at an edge, a corner or a surface of the grain in the case where they are present on the surface of the grain). Use of either of the latter two rather than the grains of the homogeneous type structure is advantageous for obtaining a high sensitivity and is preferred as well from a viewpoint of a pressure resistance performance. In the case where the silver halide grains have the above structure, the boundary at the portions having the different halogen compositions may have a distinct boundary or an indistinct boundary in which a mixed crystal is formed according to a composition difference, or a structure in which a continuous structural change is allowed to positively be provided.

In the high silver chloride emulsion used in the present invention, preferred is that having a structure in which a silver bromide-localizing phase is present in a form of a layer or non-layer as mentioned above in an inside of a silver halide grain and/or on the surface thereof. A halogen composition in the above localizing phase is preferably at least 10 mole %, more preferably exceeding 20 mole % in terms of a silver bromide content. The silver bromide content in the silver bromide-localizing phase can be analyzed with an X ray diffraction process (described in, for example, "New Experimental Chemistry Course 6, Structural Analysis" edited by Japan Chemistry Association, Maruzen). These localizing phases can be present in a grain inside, at an edge or a corner of a grain surface or on the plane thereof. The localizing phase epitaxially grown at the corner portion of the grain can be enumerated as one preferred example.

It is effective as well to further increase a silver chloride content in a silver halide emulsion for a purpose of reducing a replenishing amount of a development processing solution. In such the case, an emulsion comprising almost pure silver chloride having a silver chloride content of 98 to 100 mol % can be preferably used as well.

A sliver halide grain contained in the silver halide emulsion used in the present invention has preferably an average grain size (the grain size is defined by a diameter of a circle having the same area as that of a projected area of the grain and a number average is calculated therefrom) of 0.1 to 2 $\mu$m.

With respect to a size distribution of these grains, preferred is a so-called monodispersion in which a fluctuation coefficient (obtained by dividing a standard deviation in the grain size distribution with an-average grain size) is 20% or less, preferably 15% or less, and more preferably 10% or less. The above monodispersed emulsions are preferably used for the same layer in a blend or simultaneously coated for a purpose of obtaining a broad latitude.

There can be used as the silver halide grains contained in a photographic emulsion, the grains having a regular crystal form such as cube, octahedron and tetradecahedron, the grains having an irregular crystal form such as sphere and plate, or the composite form thereof. Further, the emulsion may consist of a mixture of the grains having various crystal forms. In the present invention, of these emulsions, preferred is the emulsion containing the grains having the regular crystal form by 50% or more, preferably 70% or more, and more preferably 90% or more. In addition thereto, preferably used as well is the emulsion in which the tabular grains having an average aspect ratio (circle area-corresponding diameter/thickness) of 5 or more, preferably 8 or more exceed 50% of the whole grains in terms of a projected area.

The silver chloride (bromide) emulsion used in the present invention can be synthesized by the processes described in "Chemie et Phisique Photographique" written by P. Glafkides (published by Paul Montel Co., Ltd., 1967), "Photographic Emulsion Chemistry" written by G. F. Duffin (published by Focal Press Co., Ltd., 1966), and "Making and Coating Photographic Emulsion" written by V. L. Zelikman, (published by Focal Press Co., Ltd., 1964). That is, there may be used any of an acid process, a neutral process and an ammonia process. Any of a single jet process, a double jet process and the combination thereof may be used as a process for reacting a water soluble silver salt with a water soluble halide. There can be used as well a process in which the grains are formed in the presence of excessive silver ions (a so-called reverse mixing process).

There can be used as one form of the double jet process, a process in which pAg of the solution in which the sliver halide grains are formed is maintained constant, that is, a so-called controlled double jet process. According to this process, a silver halide emulsion having a regular crystal form and an almost uniform grain size can be obtained.

A different kind of a metal ion or the complex ion thereof is preferably incorporated into the localizing phase or substrate of the silver halide grains according to the present invention. The preferred metal is selected from the metal ions or metal complexes belonging to the VIII group and the IIb group in the periodic table, a lead ion, and a thallium ion.

There can be used in combination for the localizing phase, mainly the ions selected from iridium, rhodium and iron or the complex ions thereof, and for the substrate, mainly the metal ions selected from osmium, iridium, rhodium, platinum, ruthenium, palladium, cobalt, nickel, and iron or the complexes ion thereof. They can be used changing the kinds and concentrations of the metal ions in the localizing phase and the substrate. Plural kinds of these metals may be used. In particular, the iron and iridium compounds are allowed to be present preferably in the silver bromide-localized phase.

These metal ion-providing compounds are incorporated into the localizing phase and/or other grain portions (substrate) by means of adding to a gelatin aqueous solution which is a dispersant, a halide aqueous solution, a silver salt aqueous solution or other aqueous solutions in the formation of the sliver halide grains, or adding in a form of a silver halide fine grain into which the metal ion is incorporated in advance to dissolve this fine grain.

The metal ions used in the present invention can be incorporated into the emulsion grains before a grain formation, during the grain formation or immediately after the grain formation. This can be changed according to what position of the grain the metal ion is incorporated into.

The silver halide emulsion used in the present invention is usually subjected to a chemical sensitization and a spectral sensitization.

There can be used singly or in combination as a chemical sensitization process, a chemical sensitization in which a chalcogen sensitizer is used (to be concrete, it includes a sulfur sensitization represented by addition of an unstable sulfur compound, a selenium sensitization with a selenium compound, and a tellurium sensitization with a tellurium compound), a noble metal sensitization represented by a gold sensitization, or a reduction sensitization. Those described in a right lower column at page 18 to a right upper column at page 22 of JP-A-62-215272 are preferably used as a compound for the chemical sensitization.

The effect given by the constitution of the light-sensitive material according to the present invention is more notable when a high silver chloride emulsion subjected to a gold sensitization is used. The emulsion used in the present invention is a so-called surface latent image type emulsion in which an latent image is formed primarily on a grain surface.

Various compounds or the precursors thereof can be added to the silver halide emulsion used in the present invention for the purposes of preventing a fog or stabilizing the photographic performances in a production process and during storing or photographic processing. Those described at pages 39 to 72 of JP-A-62-215272 described previously are preferably used as the concrete examples of these compounds.

Further, preferably used as well is the 5-arylamino-1,2,3,4-thiatriazole compound (the aryl residue has at least one electron attractive group) described in European patent EP0447647.

A spectral sensitization is carried out for a purpose of providing the emulsions contained in the respective layers of the light-sensitive material of the present invention with the spectral sensitivities in the desired wavelength regions.

In the light-sensitive material of the present invention, there can be enumerated as a spectral sensitizing dye used for the spectral sensitization in the blue, green and red regions, the compounds described in, for example, "Heterocyclic Compounds—Cyanine Dyes and Related Compounds" written by F. M. Harmer (published by John Wiley & Sons, New York, London, 1964). Those described in the right upper column at page 22 to page 38 of JP-A-62-215272 described previously are preferably used as the concrete examples of the compounds and the spectral sensitizing process. In particular, the spectral sensitizing dyes described in JP-A-3-123340 are preferred very much as a red-sensitive spectral sensitizing dye for the silver halide emulsion grains having a high silver chloride content from a viewpoint of a stability, a strength of an adsorption and a temperature dependency in an exposure.

In the case where the spectral sensitization in an infrared region is efficiently carried out in the light-sensitive material of the present invention, preferably used are the sensitizing dyes described in a left upper column at page 12 to a left lower column at page 21 of JP-A-3-15049, in the left lower column at page 4 to a left lower column at page 15 of JP-3-20730, on the 21st line at page 4 to the 54th line at page 6 of European Patent EP 0,420,011, on the 12th line at page 4 to the 33rd line at page 10 of European Patent EP 0,420,012, and in European Patent EP 0,443,466 and U.S. Pat. No. 4,975,362.

In order to incorporate these spectral sensitizing dyes into a silver halide emulsion, they may be dispersed directly in the emulsion or may be dissolved in a single solvent or mixed solvent such as water, methanol, ethanol, propanol, methyl cellosolve, and 2,2,3,3-tetrafluoropropanol to add it to the emulsion. Also, as described in JP-B-44-23389, JP-B-44-27555 and JP-B-57-22089, they may be dissolved in water in the presence of an acid or a base, and as described in U.S. Pat. Nos. 3,822,135 and 4,006,025, an aqueous solution or colloid dispersion which is prepared in the presence of a surface active agent may be added to the emulsion. Further, after dissolving in a solvent which is substantially immiscible with water, such as phenoxyethanol, the solution may be dispersed in water or a hydrophilic colloid to add it to the emulsion. As described in JP-A-53-102733 and 58-105141, a dispersion, which is prepared by dispersing the dyes directly in a hydrophilic colloid, may be added to the emulsion. A timing of adding the sensitizing dyes to the emulsion may be at any step in preparing the emulsion, which has so far been known as effective. That is, it can be selected from any of before a grain formation in a silver halide emulsion, during the grain formation, from immediately after the grain formation to before proceeding to a washing step, before a chemical sensitization, during the chemical sensitization, from immediately after the chemical sensitization to solidification of the emulsion by cooling, and in preparation of a coating solution. Most usually, it is carried out at a period of from after completion of the chemical sensitization to before coating. However, as described in U.S. Pat. Nos. 3,628,969 and 4,225,666, the dyes can be added at the same period as the chemical sensitization to carry out a spectral sensitization simultaneously with the chemical sensitization. Further, as described in JP-A-58-113928, the spectral sensitization can be carried out prior to the chemical sensitization. The sensitizing dyes can be added before completing preparation of the silver halide grains to start the spectral sensitization. Further, as taught in U.S. Pat. No. 4,225,666, a divided sensitizing dye can be added as well, that is, a part thereof is added prior to the chemical sensitization and the rest is added after the chemical sensitization. Addition of the spectral sensitizing dyes may be at any period during formation of the silver halide grains as well as the process taught in U.S. Pat. No. 4,183,756. Among them, particularly preferred is the addition of the sensitizing dyes before a washing step for the emulsion or before the chemical sensitization.

An addition amount of these spectral sensitizing dyes is extended over a wide range according to an occasion. It falls preferably in a range of $0.5\times10^{-6}$ to $1.0\times10^{-2}$ mole, more preferably $1.0\times10^{-6}$ to $5.0\times10^{-3}$ mole per mole of silver halide.

In the present invention, in the case where a sensitizing dye having a spectral sensitization sensitivity particularly in a red region to an infrared region is used, the compounds described in a right lower column at page 13 to a right lower column at page 22 of JP-A-2-157749 are preferably used in combination. Use of these compounds can specifically increase a storing performance, a stability in a processing and a supersensitization effect of a light-sensitive material.

Above all, the compounds of Formulas (IV), (V) and (VI) in the above patent are particularly preferably used in combination. These compounds are used in an amount of $0.5\times10^{-5}$ to $5.0\times10^{-2}$ mole, preferably $5.0\times10^{-5}$ to $5.0\times10^{-3}$ mole per mole of silver halide, and the advantageous use amount thereof falls in a range of 1 to 10000 times, preferably 0.5 to 5000 times per mole of the sensitizing dye.

The light-sensitive material according to the present invention is used not only for a print system in which a conventional negative printer is used but also preferably for a digital scanning exposure in which there is used a single color high density light such as a gas laser, a light emitting diode, a semiconductor laser, or the second higher harmonics-generating light source (SHG) in which the semiconductor laser or a solid state laser in which the semiconductor laser is used for an excitation light source is combined with a non-linear optical crystal. In order to make the system compact and inexpensive, preferably used are the semiconductor laser and the second higher harmonics generating light source (SHG) in which the semiconductor laser or the solid state laser is combined with the non-linear optical crystal. In particular, in order to design a compact and inexpensive equipment having a further longer life and a high stability, the semiconductor laser is preferably used and the semiconductor laser is preferably used for at least one of the exposing light sources.

In the case where such the scanning exposing light source is used, a spectral sensitivity maximum of the light-sensitive material according to the present invention can arbitrarily be settled according to a wavelength of the scanning exposing light source used. In the SHG light source obtained by combining a solid state laser in which the semiconductor laser is used for an excitation light source or the semiconductor laser with a non-linear optical crystal, a blue light and a green light can be obtained since an oscillation wavelength of the laser can be cut to a half.

Accordingly, it is possible to allow the spectral sensitivity maximums of the light-sensitive material to fall in the three conventional ranges of blue, green and red. In order to use the semiconductor laser as a light source for making the equipment inexpensive, highly stable and compact, at least two layers preferably have the spectral sensitivity maximums in a range of 670 nm or more. This is because a light emitting wavelength of the commercially available, inexpensive and stable III-V Group series semiconductor laser falls only in a red to infrared region. However, the emitting of a II-VI Group series semiconductor laser in the green and blue regions is confirmed at a laboratory level and it can be expected well that a progress in a manufacturing technique of the semiconductor laser would enable to inexpensively and stably use these semiconductor lasers. In such the case, it is less necessary that at least two layers have the spectral sensitivity maximums in 670 nm or more.

In such the scanning exposure, a time when silver halide contained in a light-sensitive material is exposed is a time necessary to expose some minute area. A minimum unit for controlling a quantity of light in the respective digital data is generally used as this minute area and called a picture element. Accordingly, an exposing time per picture element is varied according to a size of this picture element. The size of this picture element depends on a picture element density and the practical range thereof is 50 to 2000 dpi. The exposing time is preferably $10^{-4}$ second or less, further preferably $10^{-6}$ second or less, wherein the exposing time is defined by the time for exposing a picture element size on the assumption that this picture element density is 400 dpi.

For a purpose of preventing an irradiation and a halation and improving a safelight safety, preferably added to a hydrophilic colloid layer are the dyes (above all, an oxonol dye and an cyanine dye) capable of being decolored by processing, described at pages 27 to 76 of European Patent EP 0337490A2.

The dyes which deteriorates a color separation and a safelight safety by increasing in the use amounts thereof are included in these water soluble dyes. The water soluble dyes described in JP-A-3-310143, 3-310189, and 3-310139 are preferred as the dye capable of being used without deteriorating the color separation.

In the present invention, a coloring layer capable of being decolored by a processing is used in place of or in combination with the water soluble dyes. The coloring layer capable of being decolored by the processing used either may contact directly an emulsion layer or may be provided so that it contacts the emulsion layer via an intermediate layer containing gelatin and an anti-color mixing agent such as hydroquinone. This coloring layer is provided prefer-ably below (a support side) the emulsion layer which is colored to the same kind of an elementary color as that of the colored color thereof. It is possible either to independently provide all of the coloring layers corresponding to the respective elementary colors or to arbitrarily select only a part thereof to provide it. Further, it is possible as well to provide the coloring layer which is colored so that it corresponds to a plurality of the elementary color regions. In an optical reflection density in the coloring layer, an optical density value in a wavelength in which the optical density is the highest in a wavelength region used for an exposure (a visible ray region of 400 to 700 nm in case of a conventional printer exposure and a wavelength of a scanning exposure light source in case of a scanning exposure) is preferably 0.2 or more and 3.0 or less, more preferably 0.5 or more and 2.5 or less, and particularly preferably 0.8 or more and 2.0 or less.

The publicly known processes can be applied to form the coloring layer. They include, for example, a process in which the dyes are incorporated into a hydrophilic colloid layer in a form of a solid fine particle dispersion as is the case with the dyes described in a right upper column at page 3 to page 8 of JP-A-2-282244 and the dyes described in a right upper column at page 3 to a left lower column at page 11 of JP-A-3-7931, a process in which an anionic dye is mordanted to a cationic polymer, a process in which a dye is adsorbed on a fine particle of silver halide to fix it in a layer, and a process in which colloidal silver is used as described in JP-A-1-239544. There is described at pages 4 to 13 of JP-A-2-308244 as a process in which a fine powder of a dye is dispersed in a form of a solid matter, for example, a process in which there is incorporated a fine powder dye which is substantially insoluble in water at least at pH 6 or lower but substantially soluble in water at least at pH 8 or higher. Further, a process in which the anionic dye is mordanted to the cationic polymer is described at pages 18 to 26 of JP-A-2-84637. A process for preparing colloidal silver as a photo-absorbing agent is shown in U.S. Pat. Nos. 2,688,601 and 3,459,563. Of these processes, preferred are the process in which the fine powder dye is incorporated and the process in which colloidal silver is used.

Gelatin is advantageously used as a binder or a protective colloid which can be used for the light-sensitive material according to the present invention, and the other hydrophilic colloids can be used as well singly or together with gelatin. Low calcium gelatin having a calcium content of 800 ppm or less, more preferably 200 ppm or less is preferably used. Further, the anti-mold agents described in JP-A-63-271247 are preferably added in order to prevent various molds and fungi which grow in a hydrophilic colloid layer to deteriorate an image.

In subjecting the light-sensitive material according to the present invention to a printer exposure, the band stop filter described in U.S. Pat. No. 4,880,726 is preferably used, whereby a light mixture is removed to notably improve a color reproduction.

An exposed light-sensitive material can be subjected to a conventional color development processing. In case of the color light-sensitive material of the present invention, it is preferably subjected to a bleach-fixing processing following the color development for a purpose of a rapid processing. In particular, in the case where the high silver chloride emulsion described previously is used, pH of a bleach-fixing solution is preferably 6.5 or less, more preferably about 6 or less for a purpose of accelerating desilver.

Those described in the following patent publications, particularly European Patent EP 0,355,660A2 (JP-A-2-139544) are preferably used as the silver halide emulsions, the other materials (the additives) and the photographic constitutional layers (a layer arrangement) each applied to the light-sensitive material according to the present invention, and the processing processes and the additives for processing, which are applied for processing this light-sensitive material:

| Photographic elements | JP-A-62-215272 | JP-A-2-33144 | EP 0,355,660A2 |
|---|---|---|---|
| Silver halide emulsion | pp. 10, right upper colmn, line 6 to pp. 12, left lower colmn, line 5, and pp. 12, right lower colmn, line 4 from bottom to pp. 13, left upper colmn, line 17. | pp. 28, right upper colmn, line 16 to pp. 29, right lower colmn, line 11, and pp. 30, lines 2 to 5. | pp. 45, line 53 to pp. 47, line 3, and pp. 47, lines 20 to 22. |
| Silver halide solvent | pp. 12, left lower colmn, lines 6 to 14, and pp. 13, left upper colmn, line 3 from bottom to pp. 18, left lower colmn, last line. | — | — |
| Chemical sensitizer | pp. 12, left lower colmn, line 3 from bottom to right lower colmn, line 5 from bottom, and pp. 18, right lower colmn, line 1 to pp. 22, right upper colmn, line 9 from bottom. | pp. 29, right lower colmn, line 12 to last line. | pp. 47, lines 4 to 9. |
| Spectral sensitizer (spectral sensitizing process) | pp. 22, right upper colmn, line 8 from bottom to pp. 38, last line. | pp. 30, left upper colmn, lines 1 to 13. | pp. 47, lines 10 to 15. |
| Emulsion stabilizer | pp. 39, left upper colmn, line 1 to pp. 72, right upper colmn, last line. | pp. 30, left upper colmn, line 14 to right upper colmn, line 1. | pp. 47, lines 16 to 19. |
| Development accelerator | pp. 72, left lower colmn, line 1 to pp. 91, right upper colmn, line 3. | — | — |
| Color coupler (cyan, magenta and yellow couplers) | pp. 91, right upper colmn, line 4 to pp. 121, left upper colmn, line 6. | pp. 3, right upper colmn, line 14 to pp. 18, left upper colmn, last line, and pp. 30, right upper colmn, line 6 to pp. 35 right lower colmn, line 11. | pp. 4, lines 15 to 27, pp. 5, line 30 to pp. 28, last line, pp. 45, lines 29 to 31, and pp. 47, line 23 to pp. 63, line. 50 |
| Color forming accelerator | pp. 121, left lower colmn, line 7 to pp. 125, right upper colmn, line 1. | — | — |
| UV absorber | pp. 125, right upper colmn, line 2 to pp. 127, left lower colmn, last line. | pp. 37, right lower colmn, line 14 to pp. 38, left upper colmn, line 11. | pp. 65, lines 22 to 31. |
| Anti-fading agent (an image stabilizer) | pp. 127, right lower colmn, line 1 to pp. 137, left lower colmn, line 8. | pp. 36, right upper colmn, line 12 to pp. 37, left upper colmn, line 19. | pp. 4, line 30 to pp. 5, line 23, pp. 29, line 1 to pp. 45, line 25, pp. 45, lines 33 to 40, and pp. 65, lines 2 to 21. |
| High boiling and/or low boiling organic solvent | pp. 137, left lower colmn, line 9 to pp. 144, right upper, last line. | pp. 35, right lower colmn, line 14 to pp. 36, left upper, line 4. | pp. 64, lines 1 to 51. |
| Process for dispersing photographic additives | pp. 144, left lower colmn, line 1 to pp. 146, right upper colmn, line 7. | pp. 27, right lower colmn, line 10 to pp. 28, left upper, last line, and pp. 35, right lower colmn, line 12 to pp. 36, right upper colmn, line 7. | pp. 63, line 51 to pp. 64, line 56. |
| Hardener | pp. 146, right upper colmn, line 8 to pp. 155, left lower colmn, line 4. | — | — |

-continued

| Photographic elements | JP-A-62-215272 | JP-A-2-33144 | EP 0,355,660A2 |
|---|---|---|---|
| Precursor of a developing agent | pp. 155, left lower colmn, line 5 to right lower colmn, line 2. | — | — |
| Development inhibitor-releasing compound | pp. 155, right lower colmn, lines 3 to 9. | — | — |
| Support | pp. 155, right lower colmn, line 19 to pp. 156, left upper colmn, line 14. | pp. 38, right upper colmn, line 18 to pp. 39, left upper colmn, line 3. | pp. 66, line 29 to pp. 67 line 13. |
| Light-sensitive layer structure | pp. 156, left upper colmn, line 15 to right lower colmn, line 14. | pp. 28, right upper colmn, lines 1 to 15. | pp. 45, lines 41 to 52 |
| Dye | pp. 156, right lower colmn, line 15 to pp. 184, right lower colmn, last line. | pp. 38, left upper colmn, line 12 to right upper colmn, line 7. | pp. 66, lines 18 to 22. |
| Anti-color mixing agent | pp. 185, left upper colmn, line 1 to pp. 188, right lower colmn, line 3. | pp. 36, right upper colmn, lines 8 to 11. | pp. 64, line 57 to pp. 65 line 1. |
| Gradation controller | pp. 188, right lower colmn, lines 4 to 8. | — | — |
| Anti-stain agent | pp. 188, right lower colmn, line 9 to pp. 193, right lower colmn, line 10. | pp. 37, left upper colmn, last line to right lower colmn, line 13. | pp. 65, line 32 to pp. 66, line 17. |
| Surface active agent | pp. 201, left lower colmn, line 1 to pp. 210, right upper colmn, last line | pp. 18, right upper colmn, line 1 to pp. 24, right lower colmn, last line, and pp. 27, left lower colmn, line 10 from bottom to right lower colmn, line 9. | — |
| Fluorinated compound (anti-static agent, coating aid, lubricant and anti-adhesion agent) | pp. 210, left lower colmn, line 1 to pp. 222, left lower colmn, line 5. | pp. 25, left upper colmn, line 1 to pp. 27, right upper colmn, line 9. | — |
| Binder (hydrophilic colloid) | pp. 222, left lower colmn, line 6 to pp. 225, left upper colmn, last line | pp. 38, right upper colmn, lines 8 to 18. | pp. 66, lines 23 to 28. |
| Thickener | pp. 225, right upper colmn, line 1 to pp. 227, right upper colmn, line 2. | — | — |
| Anti-static agent | pp. 227, right upper colmn, line 3 to pp. 230, left upper colmn, line 1. | — | — |
| Polymer latex | pp. 230, left upper colmn, line 2 to pp. 239, last line | — | — |
| Matting agent | pp. 240, left upper colmn, line 1 to right upper colmn, last line. | — | — |
| Photographic processing method (processing steps and additives) | pp. 3, right upper colmn, line 7 to pp. 10, right upper colmn, line 5. | pp. 39, left upper colmn, line 4 to pp. 42, left upper colmn, last line. | pp. 67, line 14 to pp. 69, line 28. |

Remarks:
1. The content amended according to the Amendment of March 16, 1987 is included in the cited items of JP-A-62-215272.
2. Of the above color couplers, also preferably used as a yellow coupler are the so-called short wave type yellow couplers described in JP-A-63-231451, JP-A-63-123047, JP-A-63-241547, JP-A-1-173499, JP-A-1-213648, and JP-A-1-250944.

A cyan or yellow coupler is preferably impregnated in a loadable latex polymer (for example, U.S. Pat. No. 4,203,716) or dissolved together with a water insoluble and organic solvent soluble polymer in the presence (or absence) of the organic high boiling solvent described in the above tables to emulsify and disperse them in a hydrophilic colloid aqueous solution.

The water insoluble and organic solvent soluble polymer which can be preferably used includes the homopolymers or copolymers described in the 7th to 15th columns of U.S. Pat. No. 4,857,449 and at pages 12 to 30 of International Patent Publication WO88/00723. A methacrylate series or acrylamide series polymer, particularly the acrylamide series polymer is preferably used in terms of a stability of a dye image.

The color image preservability-improving compounds described in European Patent EP 0,277,589A2 are preferably used for the light-sensitive material according to the present invention together with a coupler. In particular, they are used preferably in combination with a pyrazoloazole coupler, a pyrrolotriazole coupler and an acylacetamide type yellow coupler.

That is, further preferably used simultaneously or singly for preventing side effects of, for example, generation of stain due to a colored dye formed by a reaction of a color developing agent or the oxidation product thereof which is remained in a layer during a storage after processing with a coupler are the compounds described in the above European Patents which are chemically combined with an aromatic amine series developing agent which is remained after a color development processing to form a chemically inactive and substantially colorless compound, and/or the compounds which are chemically combined with the oxidation product of an aromatic amine series developing agent which is remained after the color development processing to form a chemically inactive and substantially colorless compound.

Preferably used as a cyan coupler in addition to the diphenylimidazole series cyan couplers described in JP-A-2-33144 are the 3-hydroxypyridine series cyan couplers described in European Patent EP 0333185A2 (of them, particularly preferred are the coupler prepared by providing the tetra-equivalent coupler (42) exemplified as the concrete example with a chlorine splitting group to convert it to a divalent coupler, and the couplers (6) and (9)), the cyclic active methylene series cyan couplers described in JP-A-64-32260 (of them, particularly preferred are the couplers 3, 8 and 34 which are exemplified as the concrete example), the pyrrolopyrazole type cyan couplers described in European Patent EP 0456226A1, the pyrroloimidazole type cyan couplers described in European Patent EP 0484909, and the pyrrolotriazole type cyan couplers described in European Patents EP 0488248 and EP 0491197A1. Of them, the pyrrolotriazole type cyan couplers are particularly preferably used.

A magenta coupler which is used in combination with the magenta coupler of the present invention includes such the 5-pyrazolone series magenta couplers as those described in the publicly known literatures cited in the tables described above.

The 5-pyrazolone series magenta couplers from which arylthio is split of f, described in International Publications WO92/18901, WO92/18902 and WO92/18903 are preferred as the 5-pyrazolone series magenta cpupler in terms of an image preservability and a less variation in an image quality caused by processing.

A publicly known acylacetanilide type coupler is preferably used as a yellow coupler. Of them, there are preferably used a pivaloyl acetanilide type coupler having a halogen atom or an alkoxy group at an ortho position of an anilide ring, the acylacetanilide type couplers in which an acyl group is a cycloalkanecarbonyl group substituted at a 1-position, described in European Patent EP0447969A, JP-A-5-107701 and JP-A-5-113642, and the malondianilide type couplers described in European Patens EP-0482552A and EP-0524540A.

In addition to the processes described in the above tables, preferred as a processing process for the color light-sensitive material of the present invention are the processing materials and processing processes described on the 1st line of a right lower column at page 26 to the 9th line of a right upper column at page 34 of JP-A-2-207250, and on the 17th line of a left upper column at page 5 to the 20th line of a right lower column at page 18 of JP-A-4-97355.

EXAMPLES

The present invention will concretely be explained below with reference to the examples but tje present invention will not naturally be limited thereto.

Example 1

After a surface of a paper support laminated on the both sides thereof with polyethylene was subjected to a corona discharge treatment, a gelatin subbing layer containing sodium dodecylbenzenesulfonate was provided and further the various photographic constitutional layers were coated, whereby the multi-layered color photographic paper (101) having the layer constitution shown below was prepared. The coating solutions were prepared in the following manner.

Preparation of the Third Layer Coating Solution

The magenta coupler (M-4) 180.0 g, the dye image stabilizer (Cpd-5) 20.0 g, the dye image stabilizer (Cpd-2) 10.0 g, the dye image stabilizer (Cpd-6) 10.0 g, the dye image stabilizer (Cpd-7) 10.0 g, the dye image stabilizer (Cpd-8) 80.0 g, and the UV absorber (UV-1) 150.0 g were dissolved in the solvent (Solv-3) 8000 g and ethyl acetate 360 ml, and this solution was emulsified and dispersed in a 16% gelatin aqueous solution 2000 g containing a 10% sodium dodecylbenzenesulfonate aqueous solution 60 ml and citric acid 10 g, to thereby prepare the emulsified dispersion A.

Meanwhile, there was prepared the silver chlorobromide emulsion B (cube, the 1:3 mixture (silver mole ratio) of the large size emulsion B having an average grain size of 0.55 $\mu$m and the small size emulsion B having an average grain size of 0.39 $\mu$m, wherein the fluctuation coefficients in the grain size distributions were 0.10 and 0.08, respectively, and either size emulsions comprised the silver halide grains in which silver bromide 0.8 mol % was localized on a part of a grain surface and the rest was silver chloride). The green-sensitive sensitizing dyes D, E and F shown below were added to this emulsion in the amounts of $3.0\times10^{-4}$, $4.0\times10^{-5}$ and $2.0\times10^{-4}$ moles per mole of silver, respectively, to the large size emulsion B and $3.6\times10^{-4}$, $7.0\times10^{-5}$ and $2.8\times10^{-4}$ moles per mole of silver, respectively, to the small size emulsion B.

Then, this emulsion was subjected to an optimum chemical sensitization by adding a sulfur sensitizer and a gold sensitizer. The foregoing emulsified dispersion A and this silver chlorobromide emulsion B were mixed and dissolved, whereby the third layer-coating solution was prepared so that it was of the following composition.

The coating solutions for the first layer to seventh layer besides the third layer were prepared in the same manner as that in the third layer-coating solution. Sodium 1-oxy-3,5-dichloro-s-triazine was used as a hardener for the respective layers.

Further, Cpd-14 and Cpd-15 were added to the respective layers so that the whole amounts thereof became 25.0 mg/m$^2$ and 50.0 mg/m$^2$, respectively.

The following spectral sensitizing dyes were used for the silver chlorobromide emulsions contained in the respective light-sensitive emulsion layer;

Blue-sensitive Emulsion Layer

Sensitizing dye A

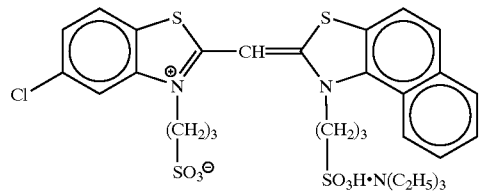

-continued

Sensitizing dye B

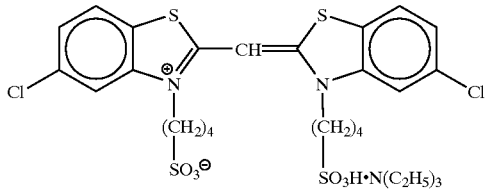

and

Sensitizing dye C

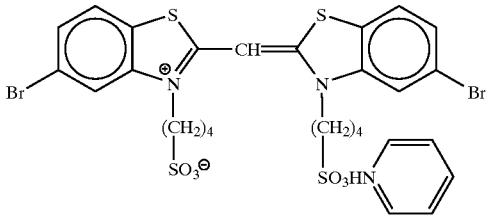

(each $1.4\times10^{-4}$ mole per mole of silver halide to the large size emulsion and each $1.7\times10^{-4}$ mole per mole of silver halide to the small size emulsion).

Green-sensitive Emulsion Layer

Sensitizing dye D

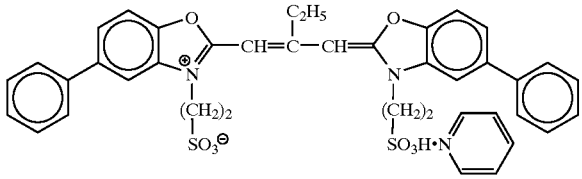

($3.0\times10^{-4}$ mole per mole of silver halide to the large size emulsion and $3.6\times10^{-4}$ mole per mole of silver halide to the small size emulsion)

Sensitizing dye E

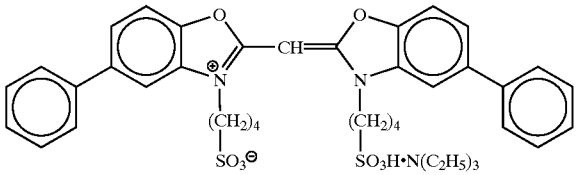

($4.0\times10^{-5}$ mole per mole of silver halide to the large size emulsion and $7.0\times10^{-5}$ mole per mole of silver halide to the small size emulsion).

Red-sensitive Emulsion Layer

Sensitizing Dye G

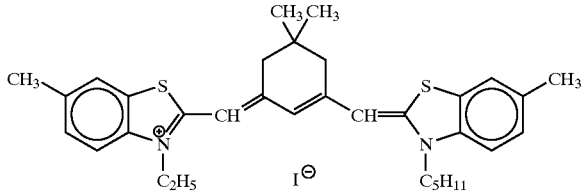

($1.0\times10^{-4}$ mole per mole of silver halide to the large size emulsion and $1.2\times10^{-4}$ mole per mole of silver halide to the small size emulsion)

Sensitizing Dye H

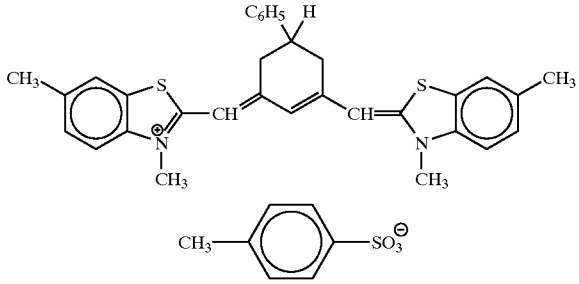

($5.0\times10^{-5}$ mole per mole of silver halide to the large size emulsion and $6.0\times10^{-5}$ mole per mole of silver halide to the small size emulsion)

Further, the following compound was added in an amount of $2.6\times10^{-3}$ mole per mole of silver halide:

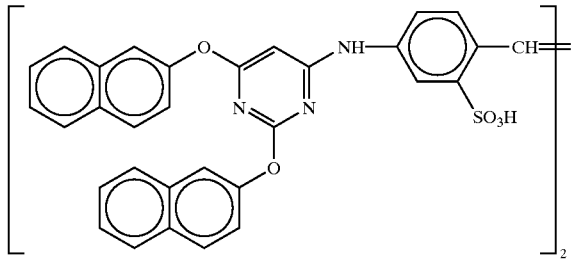

Further, 1-(5-methylureidophenyl)-5-mercaptotetrazole was added to the blue-sensitive emulsion layer, the green-sensitive emulsion layer and the red-sensitive emulsion layer in the amounts of $8.5\times10^{-5}$ mole, $7.7\times10^{-4}$ mole and $2.5\times10^{-4}$ mole per mole of silver halide, respectively.

Further, 4-hydroxy-6-methyl-1,3,3a,7-tetrazaindene was added to the blue-sensitive emulsion layer and the green-sensitive emulsion layer in the amounts of $1\times10^{-4}$ mole and $2\times10^{-4}$ mole per mole of silver halide, respectively. Further, the following dyes were added to the emulsion layers for Sensitizing dye F

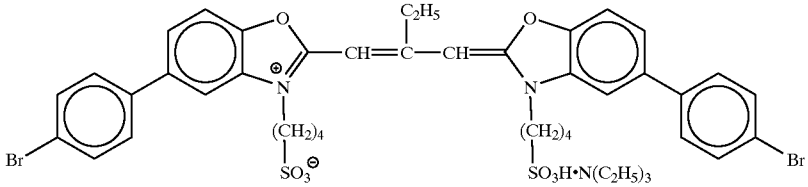

($2.0\times10^{-4}$ mole per mole of silver halide to the large size emulsion and $2.8\times10^{-4}$ mole per mole of silver halide to the small size emulsion)

preventing an irradiation (a coated amount was shown in a parenthesis).

(10mg/m$^2$)

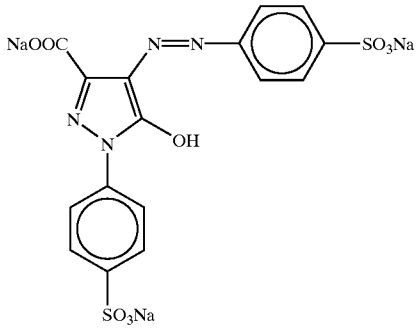

(10mg/m$^2$)

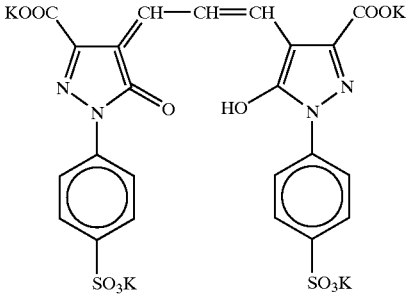

(40mg/m$^2$)

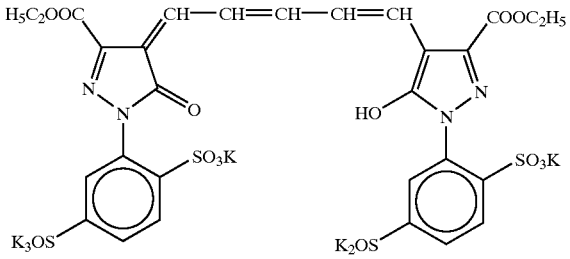

and (20mg/m$^2$)

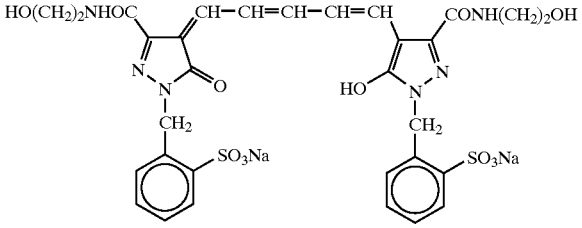

Layer Constitution

The compositions of the respective layers are shown below. The numerals represent the coated amounts (g/m$^2$). The coated amounts of the silver halide emulsions are expressed in terms of the amounts converted to silver.

Support:

Polyethylene-laminated paper

[polyethylene coated on the 1st layer side contains 14 weight % of a white pigment (titanium oxide) and a blue dye (ultramarine)].

First layer (a blue-sensitive emulsion layer):

Silver chlorobromide emulsion 0.30

(cube, 3:7 mixture (Ag mole ratio) of the large size emulsion A having an average grain size of 0.88 $\mu$m and the small size emulsion A having an average grain size of 0.70 $\mu$m, wherein the fluctuation coefficients in the grain size distributions were 0.08 and 0.10, respectively, and either size emulsions comprised silver halide in which silver bromide 0.3 mol % was localized on a part of the grain surface and the rest was silver chloride)

| | |
|---|---|
| Gelatin | 1.46 |
| Yellow coupler (ExY) | 0.68 |
| Dye image stabilizer (Cpd-1) | 0.10 |
| Dye image stabilizer (Cpd-2) | 0.05 |
| Dye image stabilizer (Cpd-3) | 0.12 |
| Solvent (Solv-1) | 0.20 |
| Solvent (Solv-5) | 0.05 |

Second layer (an anti-color mixing layer):

| | |
|---|---|
| Gelatin | 1.10 |
| Anti-color mixing agent (Cpd-4) | 0.10 |
| Solvent (Solv-7) | 0.05 |
| Solvent (Solv-2) | 0.15 |
| Solvent (Solv-3) | 0.30 |
| Solvent (Solv-1) | 0.05 |

Third layer (a green-sensitive emulsion layer):

| | |
|---|---|
| Silver chlorobromide emulsion | 0.13 |

(cube, 1:3 mixture (Ag mole ratio) of the large size emulsion B having an average grain size of 0.55 $\mu$m and the small size emulsion B having an average grain size of 0.39 $\mu$m, wherein the fluctuation coefficients in the grain size distributions were 0.10 and 0.08, respectively, and either size emulsions comprised silver halide in which silver bromide 0.8 mol % was localized on a part of the grain surface and the rest was silver chloride)

| | |
|---|---|
| Gelatin | 1.45 |
| Magenta coupler (M-4) | 0.18 |
| Dye image stabilizer (Cpd-5) | 0.02 |
| Dye image stabilizer (Cpd-2) | 0.01 |
| Dye image stabilizer (Cpd-6) | 0.01 |
| Dye image stabilizer (Cpd-7) | 0.01 |
| Dye image stabilizer (Cpd-8) | 0.08 |
| UV absorber (UV-1) | 0.15 |
| Solvent (Solv-3) | 0.80 |

Fourth layer (an anti-color mixing layer):

| | |
|---|---|
| Gelatin | 0.88 |
| Anti-color mixing agent (Cpd-4) | 0.08 |
| Solvent (Solv-7) | 0.04 |
| Solvent (Solv-2) | 0.12 |
| Solvent (Solv-3) | 0.24 |
| Solvent (Solv-1) | 0.04 |

Fifth layer (a red-sensitive emulsion layer):

| | |
|---|---|
| Silver chlorobromide emulsion | 0.20 |

(cube, 1:4 mixture (Ag mole ratio) of the large size emulsion C having an average grain size of 0.50 μm and the small size emulsion C having the average grain size of 0.41 μm, wherein the fluctuation coefficients in the grain size distributions were 0.09 and 0.11, respectively, and either size emulsions comprised silver halide in which silver bromide 0.8 mol % was localized on a part of the grain surface and the rest was silver chloride)

| | |
|---|---|
| Gelatin | 0.85 |
| Cyan coupler (ExC) | 0.31 |
| UV absorber (UV-2) | 0.18 |
| Dye image stabilizer (Cpd-9) | 0.01 |
| Additive (Cpd-10) | 0.01 |

| | |
|---|---|
| Additive (Cpd-11) | 0.01 |
| Solvent (Solv-6) | 0.25 |
| Dye image stabilizer (Cpd-8) | 0.01 |
| Dye image stabilizer (Cpd-6) | 0.01 |
| Solvent (Solv-1) | 0.01 |
| Dye image stabilizer (Cpd-1) | 0.31 |

Sixth layer (a UV absorbing layer):

| | |
|---|---|
| Gelatin | 0.55 |
| UV absorber (UV-1) | 0.38 |
| Dye image stabilizer (Cpd-12) | 0.15 |
| Dye image stabilizer (Cpd-5) | 0.02 |

Seventh layer (a protective layer):

| | |
|---|---|
| Gelatin | 1.13 |
| Acryl-modified copolymer of polyvinyl alcohol (a modification degree: 17%) | 0.05 |
| Liquid paraffin | 0.02 |
| Dye image stabilizer (Cpd-13) | 0.01 |

(ExY) Yellow Coupler

1:1 mixture of

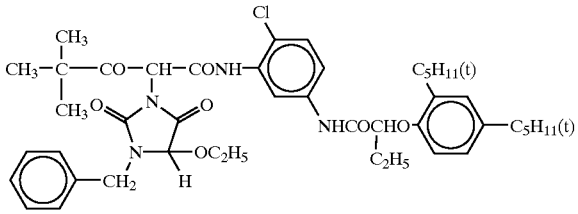

and

-continued

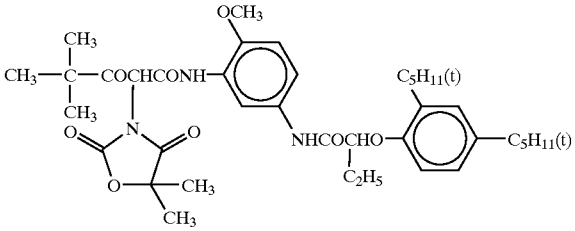

(ExC) Cyan coupler

25:75 mixture (mole ratio) of

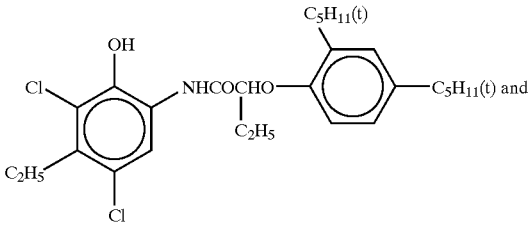

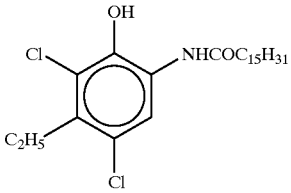

(Cpd-1) Dye Image Stabilizer

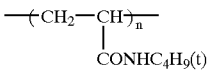

Average molecular weight: 60,000

(Cpd-2) Dye Image Stabilizer

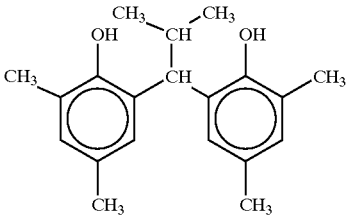

(Cpd-3) Dye Image Stabilizer

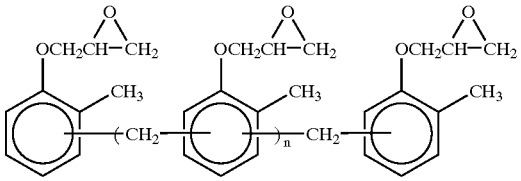

(Cpd-4) Anti-color Mixing Agent
1:1 mixture (weight ratio) of
(1)
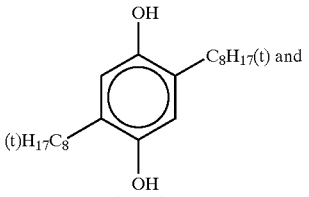
(HQ-1)
(2)
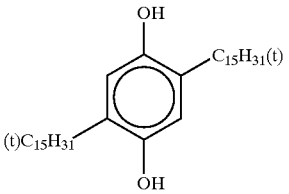
(HQ-2)
(Cpd-5) Dye Image Stabilizer
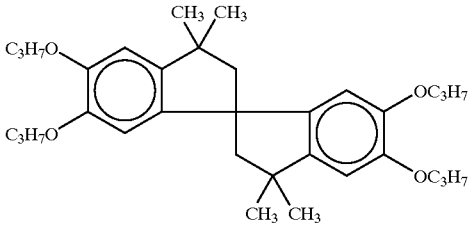
(Cpd-6) Dye Image Stabilizer
(Cpd-7) Dye Image Stabilizer
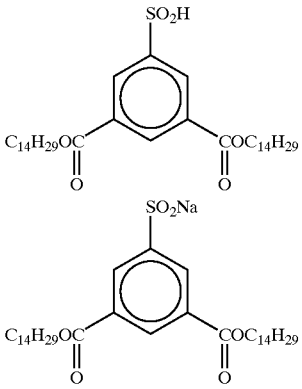
(Cpd-8) Dye Image Stabilizer
(Cpd-9) Dye Image Stabilizer
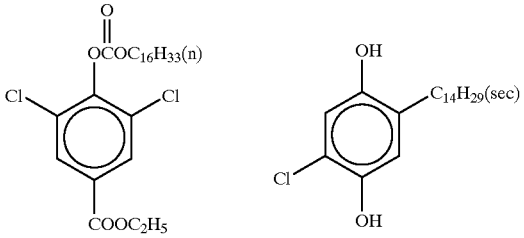
(Cpd-10) Additive
(Cpd-11) Additive
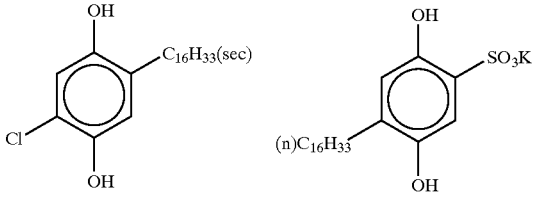
(Cpd-12) Dye image stabilizer
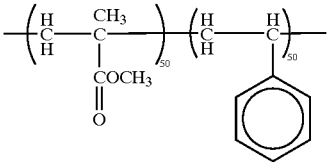
(Cpd-13) Dye image stabilizer
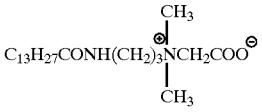
(Cpd-14) Preservative
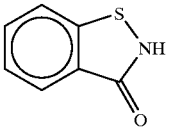
(Cpd-15) Preservative
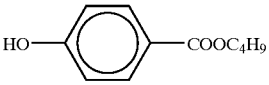
(UV-1) UV Absorber
1:5:10:5 mixture (weight ratio) of (1), (2), (3) and (4)
(1)
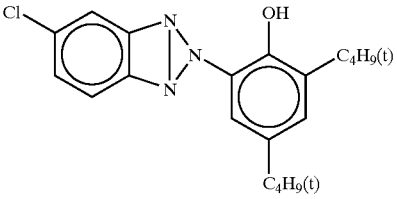
(2)
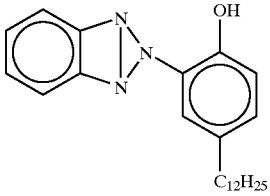
(3)
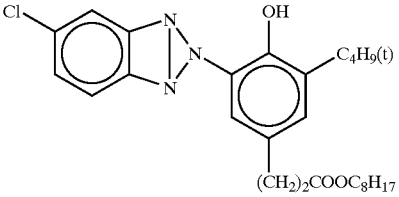

-continued (4)

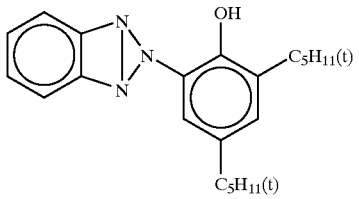

(UV-2) UV Absorber

1:2:2 mixture (weight ratio) of (1), (2) and (3)

(1)

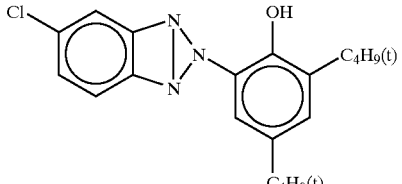

(2)

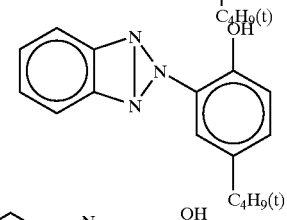

(3)

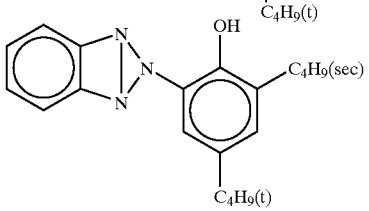

Solvent (Solv-1)

Solvent (Solv-2)

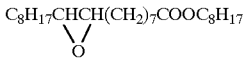

Solvent (Solv-3)

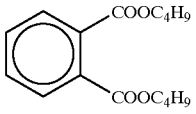

Solvent (Solv-4)

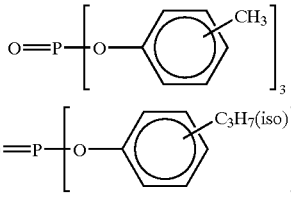

Solvent (Solv-5)

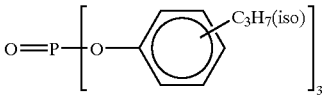

Solvent (Solv-6)

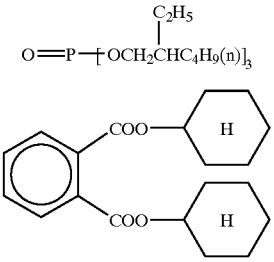

Solvent (Solv-7)

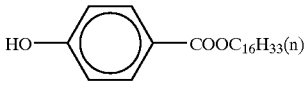

Samples 102 to 118 were prepared in the same manner as that in Sample 101 thus prepared, except that the magenta coupler contained in the third layer (the green-sensitive layer) was replaced with the couplers shown in the following Table-A and that the high boiling organic solvent and the water insoluble polymer were replaced with the compounds shown in Table-A or added, wherein a coated amount of the coupler was controlled so that it became equivalent mole based on the coupler contained in Sample 101. The high boiling organic solvent was replaced so that it became equivalent weight based on that contained in Sample 101. Poly-t-butylacrylamide (BAA) (comparison) having a number-average molecular weight of 60,000 and polystyrene (P-1) (invention) having a molecular weight of 4,000 were used as the water insoluble polymer. The addition amount thereof was 50 weight % based on the coupler. The water insoluble polymer was dissolved in ethyl acetate together with the high boiling organic solvent and the other additives and emulsified and dispersed in the same manner as that in preparing the third layer coating solution described above.

First, exposure was given to Sample 101 with a sensitometer (FWH type, a color temperature of a light source: 3200° K, manufactured by Fuji Photo Film Co., Ltd.) so that about 35% of a coated silver amount was developed to give gray.

The above samples were subjected to a 200 $m^2$ continuous processing with a paper processing machine at the following processing steps in the processing solutions of the following compositions.

| Processing step | Temperature | Time | Replenishing amount* | Tank capacity |
|---|---|---|---|---|
| Color developing | 35° C. | 45 seconds | 161 ml | 10 l |
| Bleach/fixing | 35° C. | 45 seconds | 218 ml | 10 l |
| Rinsing (1) | 35° C. | 30 seconds | — | 5 l |
| Rinsing (2) | 35° C. | 30 seconds | — | 5 l |
| Rinsing (3) | 35° C. | 30 seconds | 360 ml | 5 l |
| Drying | 80° C. | 60 seconds | | |

*Replenishing amount per $m^2$ of the light-sensitive material.

(Rinsing was of a countercurrent system from Rinsing (3) to Rinsing (1))

The compositions of the respective processing solutions are as follows:

| Color developing solution | Tank solution | Replenishing solution |
|---|---|---|
| Water | 800 ml | 800 ml |
| Ethylenediaminetetraacetic acid | 3.0 g | 3.0 g |
| Disodium 4,5-dihydroxybenzene-1,3-disulfonate | 0.5 g | 0.5 g |
| Triethanolamine | 12.0 g | 12.0 g |
| Potassium chloride | 2.5 g | — |
| Potassium bromide | 0.01 g | — |
| Potassium carbonate | 27.0 g | 27.0 g |
| Fluorescent whitening agent (Whitex 4 manufactured by Sumitomo Chem. Ind. Co., Ltd.) | 1.0 g | 2.5 g |
| Sodium sulfite | 0.1 g | 0.2 g |
| Disodium N,N-bis(sulfonatethyl) hydroxylamine | 5.0 g | 8.0 g |
| N-ethyl-N-(β-methanesulfonamidethyl)-3-methyl-4-aminoaniline 3/2 sulfate monohydrate | 5.0 g | 7.1 g |

-continued

| Color developing solution | Tank solution | Replenishing solution |
|---|---|---|
| Water was added to | 1000 ml | 1000 ml |
| pH | 10.05 | 10.45 |

(25° C./adjusted with potassium hydroxide and sulfuric acid)

Bleach/fixing solution (common to the tank solution and the replenishing solution)

| | |
|---|---|
| Water | 600 ml |
| Ammonium thiosulfate (700 g/liter) | 100 ml |
| Ammonium sulfite | 40 g |
| Iron (III) ammonium ethylenediamine-tetracetate | 55 g |
| Iron ethylenediaminetetraacetic acid | 5 g |
| Ammonium bromide | 40 g |
| Sulfuric acid (67%) | 30 g |
| Water was added to | 1000 ml |
| pH | 5.8 |

(25° C./adjusted with acetic acid and aqueous ammonia)

Rinsing solution (common to the tank solution and the replenishing solution)

| | |
|---|---|
| Sidium chloroisocyanurate | 0.02 g |
| Deionized water (dielectric constant: 5 μS/cm or less) | 1000 ml |
| pH | 6.5 |

Next, gradational exposure was given to each of Samples 101 to 118 with a light source which was passed through green and blue filters and processing was carried out in the processing solutions described above. The samples thus processed were measured for an optical density with a green light and a blue light. The maximum color densities obtained with the respective color lights were read as $D_G$ (a magenta color-developing density) and $D_B$ (a yellow color-developing density) and were described in Table-A.

Next, the samples which were exposed to a green light so that the magenta color-developing density became about 1.5 and processed were measured for an optical reflection spectrum. A maximum absorption wavelength (lmax) was read from the spectrum and was shown in Table-A.

TABLE A

| | Coupler | High Boiling Organic Solvent | Polymer | $\lambda_{max}$ | $D_G$ | $D_B$ | Remarks |
|---|---|---|---|---|---|---|---|
| 101 | M-4 | TCP | — | 545 | 2.24 | 2.35 | Comparison |
| 102 | " | " | BAA | 546 | 2.03 | 2.35 | " |
| 103 | " | " | P-1 | 545 | 2.11 | 2.35 | " |
| 104 | " | DBP | — | 543 | 2.28 | 2.30 | " |
| 105 | " | " | BAA | 544 | 2.11 | 2.30 | " |
| 106 | " | " | P-1 | 543 | 2.16 | 2.32 | " |
| 107 | " | S-2 | — | 539 | 2.25 | 2.13 | " |
| 108 | " | " | BAA | 540 | 2.07 | 2.15 | " |
| 109 | " | " | P-1 | 539 | 2.13 | 2.30 | Invention |
| 110 | M-38 | TCP | — | 552 | 2.22 | 2.36 | Comparison |
| 111 | " | " | BAA | 553 | 2.15 | 2.36 | " |
| 112 | " | " | P-1 | 552 | 2.19 | 2.36 | " |
| 113 | " | S-2 | — | 546 | 2.26 | 2.11 | " |
| 114 | " | " | BAA | 547 | 2.13 | 2.12 | " |
| 115 | " | " | P-1 | 546 | 2.24 | 2.30 | Invention |
| 116 | " | S-12 | — | 543 | 2.25 | 2.04 | Comparison |

TABLE A-continued

| | Coupler | High Boiling Organic Solvent | Polymer | $\lambda_{max}$ | $D_G$ | $D_B$ | Remarks |
|---|---|---|---|---|---|---|---|
| 117 | " | " | BAA | 544 | 2.07 | 2.10 | " |
| 118 | " | " | P-1 | 543 | 2.22 | 2.26 | Invention |

BAA: Poly(t-butyl acrylamide) number average molecular weight: 60000
TCP: Tricresylphosphate dielectric constant: 7.33 refraction index: 1.5552
DBP: Dibutylphthalate dielectric constant: 6.45 refraction index: 1.4926
P-1: Polystyrene number average molecular weight: 4000

As shown in Table-A, it can be found that in the case where the high boiling solvents S-2 and S-12 according to the present invention were added to the couplers M-4 and M-38 of the present invention (the comparative samples No. 107, 113 and 116), an absorption wavelength of a dye can be shifted to a shorter wavelength by 4 to 9 nm as compared with the cases in which the high boiling organic solvents TCP and DBP of a comparison were used (the comparative samples No. 101, 104 and 110) but shifting of the absorption wavelength is accompanied with generation of a turbidity in a coated film to lower the yellow color-developing density ($D_B$).

In the samples to which the polymer BAA which has so far been used for improving a fastness of a dye was added (the comparative samples No. 102, 105, 108, 111, 114 and 117), not only the yellow color-developing density ($D_B$) is scarcely improved but also the magenta color-developing density ($D_G$) is lowered. On the contrary, in the samples to which the polymer P-1 according to the present invention was added (the samples No. 109, 115 and 118 of the invention), the turbidity in the coated film is suppressed and the yellow color-developing density is improved to a large extent.

Further, it can be found that the magenta-developing color density is less lowered as compared with that obtained with BAA.

Thus, it is not before the coupler of the present invention is used in combination with the high boiling organic solvent having a low dielectric constant and a low refraction index and further used in combination with the polymer having an aromatic group according to the present invention that the magenta color-developing density can be less reduced and an absorption wavelength of a magenta dye can be shifted to a shorter wavelength according to a purpose without notably lowering the yellow color-developing density.

Example 2

Sample 201 was prepared in the same manner as that in Example 1, except that the composition of the first layer in Sample 101 of Example 1 was changed as shown below.

First Layer (a Blue-sensitive Emulsion Layer)

| | |
|---|---|
| Silver chlorobromide emulsion described previously | 0.22 |
| Gelatin | 1.80 |
| Yellow coupler (ExY-2) | 0.52 |
| Solvent (Solv-5) | 0.15 |
| Solvent (Solv-8) | 0.15 |
| Dye image stabilizer (Cpd-1) | 0.10 |
| Dye image stabilizer (Cpd-2) | 0.10 |
| Dye image stabilizer (Cpd-3) | 0.15 |
| Dye image stabilizer (Cpd-5) | 0.10 |
| Dye image stabilizer (Cpd-16) | 0.20 |

ExY-2

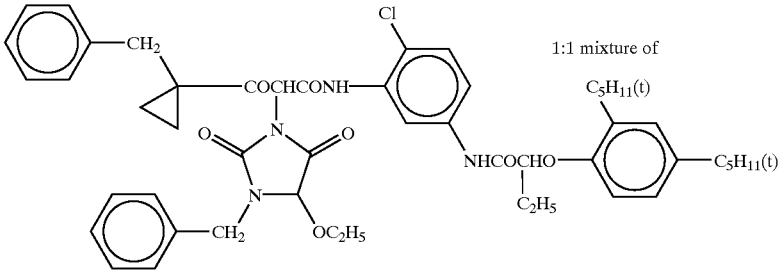

Cpd-16

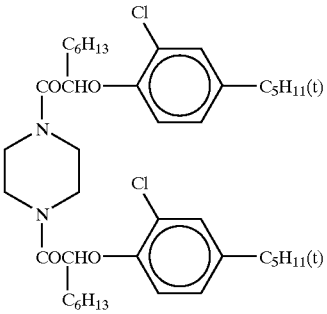

Solv-8

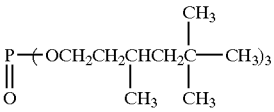

Next, Samples 202 to 211 were prepared in the same manner as that in Sample 201, except that the magenta coupler, the high boiling organic solvent and the water insoluble polymer each contained in the third layer of Sample 210 were changed or added in the same manner as that in Example 1 as shown in Table-B. These samples were exposed, processed and evaluated in the same manners as those in Example 1, and the maximum color densities $D_G$ and $D_B$ and λ max thus obtained are shown in Table-B.

TABLE B

| | Coupler | High Boiling Organic Solvent | Polymer; | Amount Added | $\lambda_{max}$ | $D_G$ | $D_B$ | Remarks |
|---|---|---|---|---|---|---|---|---|
| 201 | M-4 | TCP | — | — | 552 | 2.22 | 2.36 | Comparison |
| 202 | M-38 | S-1/S-13 (3/7) | — | — | 546 | 2.26 | 2.08 | " |
| 203 | " | S-1/S-13 (3/7) | BAA | 25% | 546 | 2.21 | 2.08 | " |
| 204 | " | S-1/S-13 (3/7) | " | 50% | 546 | 2.16 | 2.09 | " |
| 205 | " | S-1/S-13 (3/7) | " | 100% | 547 | 2.02 | 2.10 | " |
| 206 | " | S-1/S-13 (3/7) | " | 200% | 548 | 1.63 | 2.13 | " |
| 207 | " | S-1/S-13 (3/7) | P-12 | 25% | 546 | 2.25 | 2.18 | Invention |

TABLE B-continued

| | Coupler | High Boiling Organic Solvent | Polymer; | Amount Added | $\lambda_{max}$ | $D_G$ | $D_B$ | Remarks |
|---|---|---|---|---|---|---|---|---|
| 208 | " | S-1/S-13 (3/7) | " | 50% | 546 | 2.23 | 2.25 | " |
| 209 | " | S-1/S-13 (3/7) | " | 100% | 546 | 2.20 | 2.31 | " |
| 210 | " | S-1/S-13 (3/7) | " | 150% | 546 | 2.13 | 2.35 | " |
| 211 | " | S-1/S-13 (3/7) | " | 200% | 547 | 2.05 | 2.33 | " |

As shown in Comparative Samples 202 to 206 in Table-B, it can be found that while lowering of the yellow color-developing density takes place when the high boiling organic solvent according to the present invention and the polymer BAA are used for the coupler of the present invention, combined use of the polymer having an aromatic group according to the present invention improves lowering of the yellow color-developing density in Samples No. 207 to 211 of the invention.

That is, increase in the addition amount thereof not only does not lead to improving in the yellow color-developing density with the polymer BAA out of the invention but also lowers the magenta color-developing density. On the contrary, in the case where the polymer P-12 according to the present invention is used, the yellow color-developing density is improved as the use amount thereof is increased and shifting of a magenta absorption wavelength to a shorter wavelength can be achieved in an addition amount of the polymer P-12 ranging in 25% to 150% while maintaining the satisfactory color density. As can be found from the results in the example, the addition amount of 50 to 100% is particularly preferred in terms of a balance in the color-developing density.

Example 3

Samples 301 to 359 were prepared in the same manner as that in Sample 101 of Example 1, except that the magenta coupler, the high boiling organic solvent and the water insoluble polymer each contained in the third layer (the green-sensitive emulsion layer) were replaced as shown in Table-C, wherein the coupler was replaced so that it became equivalent mole based on the coupler contained in Sample 101 and the high boiling organic solvent and the polymer were replaced so that they became the same weights as those contained in Example 1, respectively. The samples thus prepared were exposed, processed and evaluated for the absorption characteristics of a magenta dye in the same manners as those in Sample 101 of Example 1.

TABLE C

| | Coupler | High Boiling Organic Solvent | Dielectric Constant | Refraction Index | Polymer | Number Average Molecular Weight | $\lambda_{max}$ | $D_G$ | $D_B$ | Remarks |
|---|---|---|---|---|---|---|---|---|---|---|
| 301 | M-39 | TCP | 7.33 | 1.555 | — | — | 552 | 2.26 | 2.35 | Comparison |
| 302 | " | " | " | " | BAA | 50000 | 552 | 2.02 | 2.35 | " |
| 303 | " | " | " | " | " | 12000 | 553 | 2.15 | 2.35 | " |
| 304 | " | " | " | " | " | 3000 | 553 | 2.21 | 2.35 | " |
| 305 | " | " | " | " | MMA | 50000 | 552 | 2.06 | 2.35 | " |
| 306 | " | " | " | " | " | 18000 | 552 | 2.17 | 2.35 | " |
| 307 | " | " | " | " | " | 4000 | 552 | 2.23 | 2.35 | " |
| 308 | " | " | " | " | P-1 | 50000 | 552 | 1.97 | 2.35 | " |
| 309 | " | " | " | " | " | 18000 | 552 | 2.08 | 2.35 | " |
| 310 | " | " | " | " | " | 8000 | 552 | 2.14 | 2.35 | " |
| 311 | " | " | " | " | " | 2500 | 552 | 2.21 | 2.35 | " |
| 312 | " | S-2 | 4.80 | 1.442 | — | — | 547 | 2.24 | 2.10 | " |
| 313 | " | " | " | " | BAA | 50000 | 547 | 2.05 | 2.11 | " |
| 314 | " | " | " | " | " | 12000 | 547 | 2.12 | 2.11 | " |
| 315 | " | " | " | " | " | 3000 | 548 | 2.17 | 2.11 | " |
| 316 | M-39 | S-2 | 4.80 | 1.442 | MMA | 50000 | 547 | 2.01 | 2.12 | Comparison |
| 317 | " | " | " | " | " | 18000 | 547 | 2.10 | 2.11 | " |
| 318 | " | " | " | " | " | 4000 | 547 | 2.16 | 2.11 | " |
| 319 | " | " | " | " | P-1 | 50000 | 547 | 2.03 | 2.30 | Invention |
| 320 | " | " | " | " | " | 18000 | 547 | 2.09 | 2.29 | " |
| 321 | " | " | " | " | " | 8000 | 547 | 2.15 | 2.30 | " |
| 322 | " | " | " | " | " | 4500 | 547 | 2.19 | 2.31 | " |
| 323 | " | " | " | " | " | 2500 | 547 | 2.21 | 2.30 | " |
| 324 | " | " | " | " | " | 1200 | 547 | 2.23 | 2.29 | " |
| 325 | " | " | " | " | P-12 | 4200 | 547 | 2.21 | 2.29 | " |
| 326 | " | " | " | " | " | 2400 | 547 | 2.23 | 2.30 | " |
| 327 | " | " | " | " | " | 1300 | 547 | 2.24 | 2.29 | " |
| 328 | " | " | " | " | P-2 | 3500 | 547 | 2.22 | 2.27 | " |
| 329 | " | " | " | " | P-17 | 4000 | 548 | 2.21 | 2.28 | " |
| 330 | " | " | " | " | P-29 | 2000 | 547 | 2.19 | 2.23 | " |
| 331 | M-39 | S-2 | 4.80 | 1.442 | P-34 | 3500 | 548 | 2.17 | 2.32 | Invention |
| 332 | " | " | " | " | P-41 | 3800 | 548 | 2.19 | 2.25 | " |

TABLE C-continued

| | Coupler | High Boiling Organic Solvent | Dielectric Constant | Refraction Index | Polymer | Number Average Molecular Weight | $\lambda_{max}$ | $D_G$ | $D_B$ | Remarks |
|---|---|---|---|---|---|---|---|---|---|---|
| 333 | " | " | " | " | P-49 | 2700 | 548 | 2.17 | 2.24 | " |
| 334 | M-22 | TCP | 7.33 | 1.5552 | — | — | 546 | 2.26 | 2.35 | Comparison |
| 335 | " | " | " | " | P-12 | 2400 | 546 | 2.24 | 2.34 | " |
| 336 | " | S-4 | 4.46 | 1.447 | — | — | 540 | 2.25 | 2.13 | " |
| 337 | " | " | " | " | P-12 | 2400 | 540 | 2.22 | 2.28 | Invention |
| 338 | " | S-10 | 4.62 | 1.481 | — | — | 543 | 2.25 | 2.25 | Comparison |
| 339 | " | " | " | " | P-12 | 2400 | 543 | 2.23 | 2.34 | Invention |
| 340 | " | S-12 | 4.47 | 1.4391 | — | — | 538 | 2.21 | 2.09 | Comparison |
| 341 | " | " | " | " | P-12 | 2400 | 538 | 2.20 | 2.26 | Invention |
| 342 | " | S-19 | 4.85 | 1.454 | — | — | 539 | 2.23 | 2.11 | Comparison |
| 343 | " | " | " | " | P-12 | 2400 | 539 | 2.20 | 2.27 | Invention |
| 344 | M-38 | TCP | 7.33 | 1.5552 | — | — | 552 | 2.22 | 2.36 | Comparison |
| 345 | " | " | " | " | P-12 | 2400 | 552 | 2.20 | 2.36 | " |
| 346 | M-38 | S-1 | 5.86 | 1.433 | — | — | 548 | 2.24 | 2.13 | Comparison |
| 347 | " | " | " | " | P-12 | 2400 | 548 | 2.22 | 2.29 | Invention |
| 348 | " | S-7 | 4.16 | 1.4477 | — | — | 545 | 2.20 | 2.09 | Comparison |
| 349 | " | " | " | " | P-12 | 2400 | 545 | 1.18 | 2.26 | Invention |
| 350 | " | S-13 | 3.96 | 1.4491 | — | — | 543 | 2.22 | 2.03 | Comparison |
| 351 | " | " | " | " | P-12 | 2400 | 543 | 2.21 | 2.25 | Invention |
| 352 | " | S-2/S-12 (1/1) | 4.64 | 1.4405 | — | — | 546 | 2.24 | 2.10 | Comparison |
| 353 | " | S-2/S/12 (1/1) | " | " | P-12 | 2400 | 546 | 2.23 | 2.28 | Invention |
| 354 | " | TCP/S-13 (1/3) | 4.80 | 1.4756 | — | — | 548 | 2.22 | 2.17 | Comparison |
| 355 | " | TCP/S-13 (1/3) | " | " | P-12 | 2400 | 548 | 2.20 | 2.32 | Invention |
| 356 | M-63 | TCP | 7.33 | 1.5552 | — | — | 550 | 2.12 | 2.35 | Comparison |
| 357 | " | " | " | " | P-12 | 2400 | 550 | 2.09 | 2.34 | " |
| 358 | " | S-2 | 4.80 | 1.4419 | — | — | 544 | 2.09 | 2.16 | " |
| 359 | " | " | " | " | P-12 | 2400 | 544 | 2.08 | 2.28 | Invention |

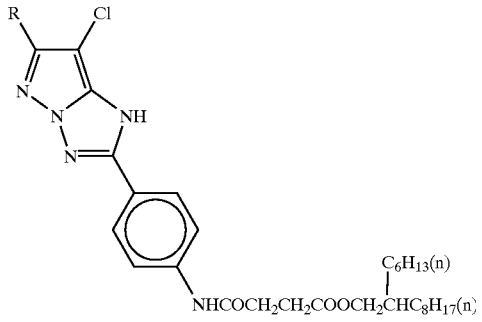

M-39 R=(t)$C_4H_9$
M-120 R=(i)$C_3H_7$
M-121 R=$C_2H_5$
M-122 R=$CH_3$

As can be found from the results shown in Table-C, also in this case, combined use of the high boiling organic solvent having a low dielectric constant and a low refraction index according to the present invention and the polymer having an aromatic group according to the present invention with the coupler of the present invention can achieve shifting of a magenta absorption wavelength to a shorter wavelength without reducing the yellow color-developing density.

Further, as can be seen from the results shown in Table-C, addition of the polymer provides a tendency toward reduction in the magenta color-developing density but this matter can be improved to a more preferable level which involves no problem on a practical use by reducing a number-average molecular weight of the polymer added to 10,000 or less. It has been confirmed that a coupler dispersion prepared by using the polymer having a number-average molecular weight of 10,000 or less has less variation in a grain size which takes place when it is stored in a refrigerator (5° C.) and less increase in a filtrating pressure which takes place when it is filtrated with a filter as compared with a coupler dispersion using the polymer having the number-average molecular weight of 10,000 or more and that a stable emulsion can be prepared.

Example 4

Samples 401 to 406 were prepared in the same manner as that in Sample 101 of Example 1, except that the magenta coupler, the high boiling organic solvent and the water insoluble polymer each contained in the third layer of Sample 101 were replaced as shown in Table-D. These samples were processed as well in the same manner as that in Example 1, and the magenta color-develping density ($D_G$) and the yellow color-develping density ($D_B$) were measured to observe an influence exerted to a color-develping density by a combination of the magenta coupler and the polymer.

TABLE D

| | Coupler | High Boiling Organic Solvent | Polymer | $D_G$ | $D_B$ | Remarks |
|---|---|---|---|---|---|---|
| 401 | M-39 | S-2 | P-12 | 2.23 | 2.30 | Invention |
| 402 | M-120 | " | " | 2.18 | 2.29 | " |
| 403 | M-121 | " | " | 2.03 | 2.29 | " |
| 404 | M-122 | " | " | 1.98 | 2.28 | " |
| 405 | M-39 | TCP | — | 2.26 | 2.35 | Comparison |
| 406 | M-39 | S-2 | — | 2.24 | 2.10 | " |

As can be seen from the results shown in Table-D, any reduction in the yellow color-develping density which is generated when the coupler of the present invention is used together with the high boiling organic solvent according to the present invention can markedly be improved by further using the polymer according to present invention in combination. Further, it can be found that while in the case where methyl or ethyl is present at a 6-position of the magenta coupler (Samples No. 403 and 404), the reduction in the magenta color-develping density is found when the polymer is used in combination, in the case where iso-propyl or tert-butyl is present there (Samples No. 401 and 402), the magenta color-develping density is scarcely lowered and it is a more preferred combination.

Example 5

The respective light-sensitive materials prepared in Example 1 and Example 2 were evaluated in the same manner as those in Example 1, except that the samples were exposed in the following manner. The results obtained were the same as those obtained in Example 1 and Example 2.

Exposure (Scanning Exposure)

There were used as a light source, 473 nm obtained by subjecting the YAG solid state laser (an oscillation wavelength: 946 nm) in which the semiconductor laser GaAlAs (an oscillation wavelength: 808.5 nm) was used as an exciting light source to a wavelength modulation with the SHG crystal of $KNbO_3$, 532 nm obtained by subjecting the $YVO_4$ solid state laser (an oscillation wavelength: 1064 nm) in which the semiconductor laser GaAlAs (an oscillation wavelength: 808.7 nm) was used as an exciting light source to a wavelength modulation with the SHG crystal of KTP, and AlGaInP (an oscillation wavelength: about 670 nm: Type No. TOLD 9211 manufactured by Toshiba Co., Ltd.). There was used an equipment in which a laser ray could be scanned for exposing in order on a color photographic paper moving to a direction vertical to a scanning direction with a rotary polyhedron. A relationship of the density (D) of the light-sensitive material with the quantity (E) of light, D-log E, was obtained with this equipment while changing the quantity of light, wherein the laser rays of the three wavelengths were subjected to the modulation of the quantity of light by means of an external modulator to thereby control an exposure. This scanning exposure was carried out at 400 dpi, wherein an average exposing time per a picture element was about $5\times10^{-8}$ second. The Peltier element was used to maintain a temperature constant in order to control change in the quantity of light caused by change in the temperature.

Example 6

Samples 501 to 514 were prepared in the same manner as that in Sample 101 of Example 1, except that the magenta coupler, the high boiling organic solvent and the water insoluble polymer each contained in the third layer of Sample 101 were changed as shown in Table-E. These samples were processed as well in the same manner as that in Example 1, and the magenta color-develping density ($D_G$) and the yellow color-develping density ($D_B$) were measured.

TABLE E

| | Coupler | High Boiling Organic Solvent | Polymer | $D_G$ | $D_B$ | Remarks |
|---|---|---|---|---|---|---|
| 501 | M-98 | S-2 | — | 2.31 | 2.06 | Comparison |
| 502 | " | " | P-12 | 2.12 | 2.28 | Invention |
| 503 | M-99 | S-2 | — | 2.37 | 2.08 | Comparison |
| 504 | " | " | P-12 | 2.34 | 2.30 | Invention |
| 505 | M-100 | S-2 | — | 2.41 | 2.07 | Comparison |
| 506 | " | " | P-12 | 2.40 | 2.31 | Invention |

TABLE E-continued

| | Coupler | High Boiling Organic Solvent | Polymer | $D_G$ | $D_B$ | Remarks |
|---|---|---|---|---|---|---|
| 507 | M-101 | S-2 | — | 2.43 | 2.08 | Comparison |
| 508 | " | " | P-12 | 2.41 | 2.31 | Invention |
| 509 | M-102 | S-2 | — | 2.36 | 2.06 | Comparison |
| 510 | " | " | P-12 | 2.34 | 2.29 | Invention |
| 511 | M-39 | S-2 | — | 2.22 | 2.09 | Comparison |
| 512 | " | " | P-12 | 2.20 | 2.27 | Invention |
| 513 | M-94 | S-2 | — | 2.24 | 2.05 | Comparison |
| 514 | " | " | P-12 | 2.21 | 2.30 | Invention |

It can be found from the results shown in Table-E that use of any of the couplers of the present invention in combination with the polymer according to the present invention can improve reduction in the yellow color-develping density which takes place when the coupler is used singly and that above all, combined use of M-99, M-100, M-101 and M-102 in which $R_{21}$ is a secondary or tertiary alkyl group or a cycloalkyl group with the polymer according to the present invention decreases reduction in the magenta color-develping density as compared with M-98 in which $R_{21}$ is methyl and it is a preferred combination.

Further, it can be found that among the couplers of the present invention, M-99 to M-102 each having a phosphonic acid ester type ballast group provide the high magenta color-develping density as compared with M-39 and that they are more preferred couplers.

Next, Samples 501 to 514 were stored in the condition of 80° C.–70% for 24 hours and then irradiated with a xenon light of 80,000 lux (intermittent irradiation with bright for 5 hours/dark for one hour) for one month to evaluate a residual rate of a dye image at an initial density of 1.5. The results thereof are shown in Table-F.

TABLE F

| Sample | Coupler | Light-discoloration (Xe 80,000 lux for 1 month) Residual Rate Δ % (improved extent) | | |
|---|---|---|---|---|
| 501 | M-98 | 62% | 8% | Comparison |
| 502 | " | 70% | | Invention |
| 503 | M-99 | 82% | 7% | Comparison |
| 504 | " | 89% | | Invention |
| 505 | M-100 | 84% | 12% | Comparison |
| 506 | " | 96% | | Invention |
| 507 | M-101 | 73% | 15% | Comparison |
| 508 | " | 88% | | Invention |
| 509 | M-102 | 81% | 10% | Comparison |
| 510 | " | 91% | | Invention |
| 511 | M-39 | 79% | 4% | Comparison |
| 512 | " | 83% | | Invention |
| 513 | M-94 | 83% | 8% | Comparison |
| 514 | " | 91% | | Invention |

It can be found from the results shown in Table-F that use of any of the magenta couplers of the present invention in combination with the polymer according to the present invention improves a light fastness. Of them, in the samples using the couplers M-100, M-101 and M-102 in which $R_{21}$ is adamantyl or the other cycloalkyl group, the light fastness is improved to a larger extent and it can be said that they provide more preferred combination with the polymer according to the present invention.

Further, as can be seen from a comparison of M-39 with M-99, M-99 having a phosphonic acid ester structure on a ballast group is more preferably used in combination with the polymer according to the present invention because of a better light fastness-improving effect.

Use of the magenta coupler of the present invention in combination with the high boiling organic solvent having a dielectric constant of 6.0 or less and a refraction index of 1.5 or less and the water insoluble polymer having an aromatic group can provide a silver halide color photographic light-sensitive material which excels in a color reproduction, a color developability and an image stability. Further, since even reduction in the use amounts of a yellow coupler and a magenta coupler can provide a good image, a highly economical silver halide color photographic light-sensitive material can be provided.

While the invention has been described in detail and with reference to specific embodiments thereof, it will be apparent to one skilled in the art that various changes and modifications can be made therein without departing from the spirits and scope thereof.

What is claimed is:

1. A silver halide color photographic light-sensitive material comprising a support and provided thereon a yellow color-developing light-sensitive silver halide emulsion layer, a magenta color-developing light-sensitive silver halide emulsion layer and a cyan color-developing light-sensitive silver halide emulsion layer each having a different color-sensitivity, wherein the magenta color-developing light-sensitive silver halide emulsion layer contains at least one non-diffusible dye-forming coupler represented by the following Formula (M), a high boiling organic solvent having a dielectric constant of 6.0 or less and a refraction index of 1.50 or less, and at least one water insoluble polymer which is obtained by polymerizing at least one monomer having an aromatic group:

Formula (M)

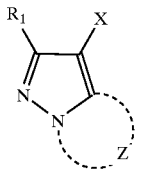

wherein $R_1$ represents a hydrogen atom or a substituent; Z represents a non-metal atomic group which is necessary to form a 5-membered azole ring containing 2 to 4 nitrogen atoms and the azole ring may contain a substituent; and X represents a hydrogen atom or a group capable of splitting off upon a coupling reaction with an oxidation product of a developing agent, wherein the water insoluble polymer has a number-average molecular weight of 1,000 to 5,000.

2. The silver halide color photographic light-sensitive material described in claim 1, wherein the dye-fronting coupler represented by Formula (M) is represented by the following Formula (M-I), (M-II), (M-III), (M-IV) or (M-V):

(M-I)

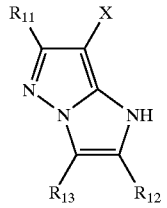

(M-II)

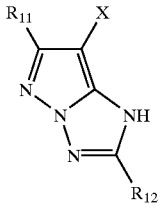

(M-III)

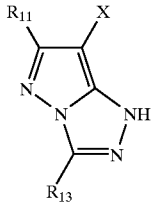

(M-IV)

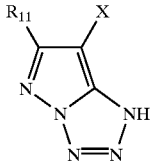

(M-V)

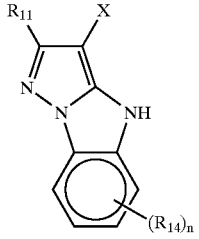

wherein $R_{11}$, $R_{12}$, $R_{13}$ and $R_{14}$ each represent a hydrogen atom or a substituent.

3. The silver halide color photographic light-sensitive material described in claim 1, wherein the dye-forming coupler represented by Formula (M) is represented by the following Formula (M-IIA) or (M-IIIA):

(M-IIA)

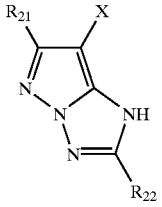

-continued (M-IIIA)

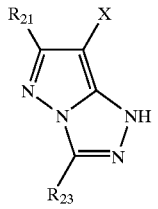

wherein $R_{21}$ represents a secondary or tertiary alkyl group or a secondary or tertiary cycloalkyl group; and $R_{22}$ and $R_{23}$ each represent a hydrogen atom or a substituent.

4. The silver halide color photographic light-sensitive material described in claim 3, wherein $R_{21}$ in Formulas (M-IIA) and (M-IIIA) is a secondary or tertiary cycloalkyl group or a secondary or tertiary bicycloalkyl group.

5. The silver halide color photographic light-sensitive material described in claim 3, wherein $R_{21}$ in Formulas (M-IIA) and (M-IIIA) is an adamantyl group, 2,2,2-bicycloctane-1-yl group, 1-alkylcyclopropane-1-yl group, 1-alkylcyclohexane-1-yl group, or 2,6-dialkylcyclohexane-1-yl group.

6. The silver halide color photographic light-sensitive material described in claim 1, wherein the water insoluble polymer is a polymer having at least a monomer unit derived from at least one of styrene, α-methylstyrene and β-methylstyrene.

7. The silver halide color photographic light-sensitive material described in claim 1, wherein the coupler of Formula (M) has at least one group represented by —P═O as a partial structure in the molecule thereof, provided that a part of X is excluded.

8. The silver halide color photographic light-sensitive material described in claim 1, wherein the high boiling organic solvent has a dielectric constant of 5.5 or less and has a solubility of 1% or less to water.

9. The silver halide color photographic light-sensitive material described in claim 1, wherein the magenta coupler represented by Formula (M) is used in an amount of 0.01 to 10 mmol/$m^2$ in the silver halide color photographic light-sensitive material.

10. The silver halide color photographic light-sensitive material described in claim 1, wherein the high boiling organic solvent is used in an amount of 0.2 to 10.0 based on the magenta coupler in terms of a weight ratio.

11. The silver halide color photographic light-sensitive material described in claim 1, wherein the water insoluble polymer is used in an amount of 0.05 to 5.0 based on the magenta coupler in terms of a weight ratio.

12. The silver halide color photographic light-sensitive material described in claim 1, wherein the support is a reflection type support.

13. The silver halide color photographic light-sensitive material described in claim 1, wherein the high boiling organic solvent has a refraction index of 1.490 or less.

14. The silver halide color photographic light-sensitive material described in claim 13, wherein the high boiling organic solvent has a refraction index of 1.48 or less.

15. The silver halide color photographic light-sensitive material described in claim 13, wherein the high boiling organic solvent has a refraction index of 1.442 or less.

16. The silver halide color photographic light-sensitive material described in claim 1, wherein the high boiling organic solvent has a dielectric constant of 5.5 or less.

17. The silver halide color photographic light-sensitive material described in claim 1, wherein the high boiling organic solvent has a dielectric constant of 3.0 to 5.0.

18. The silver halide color photographic light-sensitive material described in claim 1, wherein the water insoluble polymer is a polymer consisting of a repetitive unit which is derived from styrene, α-methylstyrene or β-methylstyrene, or monomers obtained by providing substituents on the benzene rings thereof.

19. The silver halide color photographic light-sensitive material described in claim 1, wherein the water insoluble polymer has a number-average molecular weight of 1,000 to 4,500.

20. A method of forming an image comprising image-wise exposing a silver halide color photographic light-sensitive material comprising a support and provided thereon a yellow color-developing light-sensitive silver halide emulsion layer, a magenta color-developing light-sensitive silver halide emulsion layer and a cyan color-developing light-sensitive silver halide emulsion layer each having a different color-sensitivity, wherein the magenta color-developing light-sensitive silver halide emulsion layer contains at least one non-diffusible dye-forming coupler represented by the following formula (M), a high boiling organic solvent having a dielectric constant of 6.0 or less and a refraction index of 1.50 or less, and at least one water insoluble polymer which has a number-average molecular weight of 200,000 or less and is obtained by polymerizing at least one monomer having an aromatic group:

Formula (M)

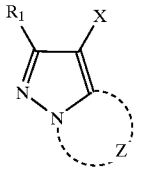

wherein $R_1$ represents a hydrogen atom or a substituent; Z represents a non-metal atomic group which is necessary to form a 5-membered azole ring containing 2 to 4 nitrogen atoms and the azole ring may contain a substituent; and X represents a hydrogen atom or a group capable of splitting off upon a coupling reaction with an oxidation product of a developing agent, wherein the dye-forming coupler represented by Formula (M) is represented by the following Formula (M-IIA) or (M-IIIA):

(M-IIA)

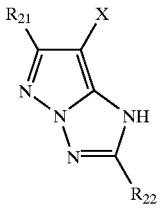

(M-IIIA)

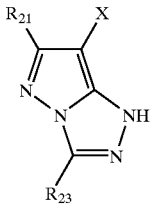

wherein $R_{21}$ represents a secondary or tertiary cycloalkyl group or a secondary or tertiary bicycloalkyl group; and $R_{22}$ and $R_{23}$ each represent a hydrogen atom or a substituent to allow an absorption wavelength of a magenta dye in the silver halide color photographic light-sensitive material to shift to a shorter wavelength, and developing the exposed silver halide color photographic light-sensitive material.

21. A silver halide color photographic light-sensitive material comprising a support and provided thereon a yellow color-developing light-sensitive silver halide emulsion layer, a magenta color-developing light-sensitive silver halide emulsion layer and a cyan color-developing light-sensitive silver halide emulsion layer each having a different color-sensitivity, wherein the magenta color-developing light-sensitive silver halide emulsion layer contains at least one non-diffusible dye-forming coupler represented by the following Formula (M), a high boiling organic solvent having a dielectric constant of 6.0 or less and a refraction index of 1.50 or less, and at least one water insoluble polymer which is obtained by polymerizing at least one monomer having an aromatic group:

Formula (M)

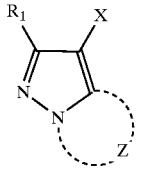

wherein $R_1$ represents a hydrogen atom or a substituent; Z represents a non-metal atomic group which is necessary to form a 5-membered azole ring containing 2 to 4 nitrogen atoms and the azole ring may contain a substituent; and X represents a hydrogen atom or a group capable of splitting off upon a coupling reaction with an oxidation product of a developing agent, wherein the water insoluble polymer has a number-average molecular weight of 200,000 or less, wherein the dye-forming coupler represented by Formula (M) is represented by the following Formula (M-IIA) or (M-IIIA):

(M-IIA)

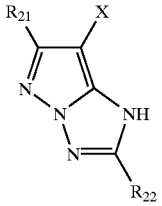

(M-IIIA)

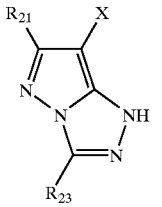

wherein $R_{21}$ in Formulas (M-IIA) and (M-IIIA) is a secondary or tertiary cycloalkyl group or a secondary or tertiary bicycloalkyl group and $R_{22}$ and $R_{23}$ each represent a hydrogen atom or a substituent.

22. The silver halide color photographic light-sensitive material described in claim 21, wherein $R_{21}$ in Formulas (M-IIA) and (M-IIIA) is an adamantyl group, 2,2,2-bicycloctane-1-yl group, 1-alkylcyclopropane-1-yl group, 1-alkylcyclohexane-1-yl group, or 2,6-dialkylcyclohexane-1-yl group.

* * * * *